US011571913B2

(12) United States Patent
Friedrich et al.

(10) Patent No.: US 11,571,913 B2
(45) Date of Patent: Feb. 7, 2023

(54) RECONFIGURABLE SUPPORT PADS FOR FABRIC IMAGE TRANSFERS

(71) Applicant: 240 Tech LLC, Santa Ana, CA (US)

(72) Inventors: Kris Otto Friedrich, La Quinta, CA (US); Blair Kristine Dorsey, San Juan Capistrano, CA (US)

(73) Assignee: 240 Tech LLC, Santa Ana, CA (US)

( * ) Notice: Subject to any disclaimer, the term of this patent is extended or adjusted under 35 U.S.C. 154(b) by 0 days.

(21) Appl. No.: 16/432,273

(22) Filed: Jun. 5, 2019

(65) Prior Publication Data

US 2019/0381808 A1 Dec. 19, 2019

Related U.S. Application Data

(60) Provisional application No. 62/681,381, filed on Jun. 6, 2018.

(51) Int. Cl.
*B41J 2/01* (2006.01)
*B41J 3/407* (2006.01)
(Continued)

(52) U.S. Cl.
CPC ..... *B41J 3/4078* (2013.01); *B41J 13/0009* (2013.01); *B41J 11/00216* (2021.01)

(58) Field of Classification Search
None
See application file for complete search history.

(56) References Cited

U.S. PATENT DOCUMENTS 5,765,476 A 6/1998 McKeever
6,096,475 A 8/2000 Hare et al.
(Continued)

FOREIGN PATENT DOCUMENTS

CN 304341074 S 11/2017
CN 107487070 A 12/2017
(Continued)

OTHER PUBLICATIONS

Co-pending U.S. Appl. No. 15/810,497, filed Nov. 13, 2017 by Kris Otto Friedrich et al.
(Continued)

*Primary Examiner* — Erica S Lin
*Assistant Examiner* — Tracey M Mcmillion
(74) *Attorney, Agent, or Firm* — Knobbe, Martens, Olson & Bear, LLP

(57) ABSTRACT

The techniques described herein relate generally to reconfigurable support pads for fabric image transfers. Specifically, according to one or more embodiments of the present disclosure, reconfigurable support pads are provided for fabric image transfers (e.g., silk screening, heat transfer, direct-to-garment printing, etc.). In particular, the techniques herein provide for various adjustable configurations of portions of the fabric substrate support, which may be changed for different thicknesses of garments, and more particularly, that allow for varied thicknesses found on the same garment. For example, by configuring the support in a first "flat" configuration, a plain tee shirt may lay flat, and then configuring the support in a second "two-tiered" configuration, with one portion lower (or higher) than the other, allows for a hoodie with a thicker pocket portion at the "belly" of the garment to also lay flat. Other configurations are also available, whether manually adjusted or else dynamically controlled (e.g., using actuators) based on the type of garment selected on an associated control system.

13 Claims, 23 Drawing Sheets

(51) Int. Cl.
*B41J 13/00* (2006.01)
*B41J 11/00* (2006.01)

(56) References Cited

U.S. PATENT DOCUMENTS

| | | | | |
|---|---|---|---|---|
| 6,651,554 | B1 * | 11/2003 | Williams | B41F 15/0863 101/126 |
| 7,040,748 | B2 | 5/2006 | Niimi et al. | |
| 7,413,301 | B2 * | 8/2008 | Niimi | B41J 2/01 101/126 |
| 7,498,277 | B2 | 3/2009 | Pace et al. | |
| 7,765,927 | B1 * | 8/2010 | Liu | B41J 11/06 101/474 |
| 7,997,677 | B2 | 8/2011 | Navazo et al. | |
| 8,092,003 | B2 | 1/2012 | Sloan | |
| 9,050,220 | B2 | 6/2015 | Digiacomantonio et al. | |
| 9,611,401 | B2 | 4/2017 | Mozel et al. | |
| 9,707,133 | B2 | 7/2017 | Digiacomantonio et al. | |
| 9,849,665 | B2 | 12/2017 | Livingston | |
| 10,131,160 | B2 | 11/2018 | Hoffman et al. | |
| 10,189,278 | B1 | 1/2019 | Friedrich et al. | |
| 2002/0142710 | A1 * | 10/2002 | Saldana | B24B 49/16 451/168 |
| 2003/0197772 | A1 * | 10/2003 | Iwatsuki | B41J 3/4078 347/104 |
| 2006/0152568 | A1 | 7/2006 | Niimi et al. | |
| 2007/0103529 | A1 | 5/2007 | Pearl et al. | |
| 2009/0097044 | A1 | 4/2009 | Zach | |
| 2013/0057632 | A1 * | 3/2013 | Moriya | B41J 11/06 347/104 |
| 2013/0278692 | A1 | 10/2013 | Marino et al. | |
| 2015/0152274 | A1 | 6/2015 | Pearl et al. | |
| 2015/0360460 | A1 | 12/2015 | Livingston | |
| 2016/0024709 | A1 | 1/2016 | Walker | |
| 2016/0136978 | A1 | 5/2016 | Hamada | |
| 2017/0320316 | A1 | 11/2017 | Nakamura et al. | |
| 2018/0207954 | A1 | 7/2018 | Schiestl | |
| 2018/0216661 | A1 * | 8/2018 | Gonzalez | F16C 17/03 |
| 2018/0339531 | A1 | 11/2018 | Perera et al. | |
| 2019/0217632 | A1 | 7/2019 | Friedrich et al. | |
| 2020/0230946 | A1 | 7/2020 | Li et al. | |

FOREIGN PATENT DOCUMENTS

| | | | | |
|---|---|---|---|---|
| CN | 107574697 | A | 1/2018 | |
| CN | 207432996 | U | 6/2018 | |
| EP | 2509791 | B1 | 10/2013 | |
| EP | 3121016 | A1 * | 1/2017 | B41J 11/0015 |
| EP | 3814141 | | 5/2021 | |
| JP | 4147993 | B2 | 9/2008 | |
| WO | WO 2017/034787 | A1 | 3/2017 | |
| WO | WO-2019041487 | A1 | 3/2019 | |
| WO | WO-2019051190 | A1 | 3/2019 | |
| WO | WO-2019236678 | | 12/2019 | |

OTHER PUBLICATIONS

Images Magazine. Schulze Pretreatmaker. 360 Communications Ltd. Website. Jun. 26, 2017. 3 pages. URL:< https://images-magazine.com/schulze-pretreatmaker/>.

Kornit Digital. Kornit Allegro: Roll to Roll Printer. Web page. Kornit Digital, Copyright 2019. Accessed Apr. 1, 2019. 6 pages. URL:< https://www.kornit.com/k-solution/allegro/.

PCT/US2018/049898 International Search Report and Written Opinion dated Oct. 18, 2018.

PCT/US2019/035541 International Search Report and Written Opinion dated Aug. 12, 2019.

ROQ. Automatic Screen Printing Machines. ROQ. Website. Accessed Apr. 3, 2019. 4 pages. URL:< http://roqinternational.com/solutions/screen-printing-machines/.

ROQ. ROQprint Oval Pro. ROQ. Website. Accessed Apr. 3, 2019. 13 pages. URL:< http://roqinternational.com/product/screen-printing-machines/roqprint-oval-pro/.

Schulze. PRETREATmaker Line. Walter Schulze GmbH. Website; Accessed Jul. 1, 2019. 3 pages. URL:< http://www.pretreatmaker.com/line-en.html>.

U.S. Appl. No. 15/847,003 Notice of Allowance dated Oct. 4, 2018.

U.S. Appl. No. 15/847,003 Notice of Allowance dated Sep. 14, 2018.

U.S. Appl. No. 15/847,003 Office Action dated Mar. 9, 2018.

U.S. Appl. No. 16/235,609 Office Action dated May 2, 2019.

FLEXcon Company, Inc. Flexcon Develops Breakthrough UV Inkjet Topcoat Technology to Further Digital Printing Innovation. Available at https://www.flexcon.com/about/news-events/news-releases/dpm-uvij. Accessed on Sep. 24, 2019.

Kornit Avalanche Platform—Industrial printing platform for high volume and quick turnaround. Available at https://cloud.3dissue.com/122286/122537/143531/AVALANCHREV6/index.html. Accessed on Sep. 25, 2019.

PCT/US2018/049898 Third party observation submitted by Anonymous; dated Aug. 20, 2019.

PCT/US2018/049898 Third party observation submitted by Anonymous; dated Jun. 13, 2019.

PCT/US2018/049898 Third party observation submitted by Hirsch; dated Aug. 10, 2019.

Supplementary European Search Report for EP Application No. 19814925.4 dated Jan. 31, 2022 in 12 pages.

* cited by examiner

RECONFIGURABLE SUPPORT PADS FOR FABRIC IMAGE TRANSFERS

CROSS-REFERENCE

This application claims the benefit of U.S. Provisional Application No. 62/681,381, filed Jun. 6, 2018, which application is incorporated herein by reference in its entirety.

TECHNICAL FIELD

The present disclosure relates generally to fabric image transfers, and, more particularly, to reconfigurable support pads for fabric image transfers.

BACKGROUND OF THE INVENTION

Screen printing or "silk-screening" is a printing technique that has been around for centuries in which a mesh is used to transfer ink onto a substrate (e.g., paper or fabric), except in areas made impermeable to the ink by a blocking stencil. Typically, a blade or squeegee is moved across the screen to fill the open mesh apertures with ink and press the screen onto the substrate, such that the ink wets the substrate where not blocked by the stencil, leaving the ink behind when the screen is removed from the substrate. One color (or a single mixture of colors) is printed at a time so that several screens can be used to produce a multicolored image or design.

Enhancements to silk-screening have occurred over time, such as rotary multi-screen manual systems, automated silk-screening assembly lines, continuous rotating cylinder printing, and others (e.g., heat transfer vinyl (HTV) or transfer printing). However, more recent advancements in technology have adapted inkjet printing for fabrics (e.g., tee shirts), allowing for greater flexibility in design and processing. For example, colorful pictures and intricate patterns can easily be created and transferred to a fabric surface in high resolution through computerized ink jets with various colored inks in a process typically referred to in the art as "direct to garment" (DTG) inkjet printing.

SUMMARY OF THE INVENTION

The techniques described herein relate generally to reconfigurable support pads for fabric image transfers. Specifically, according to one or more embodiments of the present disclosure, reconfigurable support pads are provided for fabric image transfers (e.g., silk screening, heat transfer, direct-to-garment printing, etc.). In particular, the techniques herein provide for various adjustable configurations of portions of the fabric substrate support, which may be changed for different thicknesses of garments, and more particularly, that allow for varied thicknesses found on the same garment. For example, by configuring the support in a first "flat" configuration, a plain tee shirt may lay flat, and then configuring the support in a second "two-tiered" configuration, with one portion lower (or higher) than the other, allows for a hoodie with a thicker pocket portion at the "belly" of the garment to also lay flat. Other configurations are also available, whether manually adjusted or else dynamically controlled (e.g., using actuators) based on the type of garment selected on an associated control system.

An aspect of the invention is directed to a pallet assembly for direct-to-garment printing, comprising: a support configured to accept a garment, said garment comprising a print area; and a plurality of removable pads borne by the support, wherein the pads are configured to lie under at least a portion of the print area of the garment, and wherein at least two of the pads are configured to be positioned in a vertically overlying manner.

Further aspects of the invention are directed to a pallet assembly for direct-to-garment printing, comprising: one or more supports configured to accept a garment, said garment comprising a print area; and a plurality of pads, wherein the pads are configured to lie under at least a portion of the print area of the garment, and wherein top surfaces of at least two of the pads are configured to have an adjustable vertical position relative to one another.

Additionally, aspects of the invention are directed to a method of transferring a layer of ink to a fabric with a variable thickness, comprising the steps of: (a) adjusting a first pad relative to a second pad such that a difference in height between said first pad and said second pad accommodates a variation in thickness in a first portion of said fabric as compared to a second portion of said fabric; (b) placing said first and second portions of said fabric over said first and second pads such that a top surface of said first and second portions of said fabric are within a single plane; (c) fixing a position of said fabric relative to said first pad and said second pad; and (d) transferring said layer of ink to said first and second portions of said fabric without rearranging said first and second portions of said fabric.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

The novel features of the invention are set forth with particularity in the appended claims. A understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
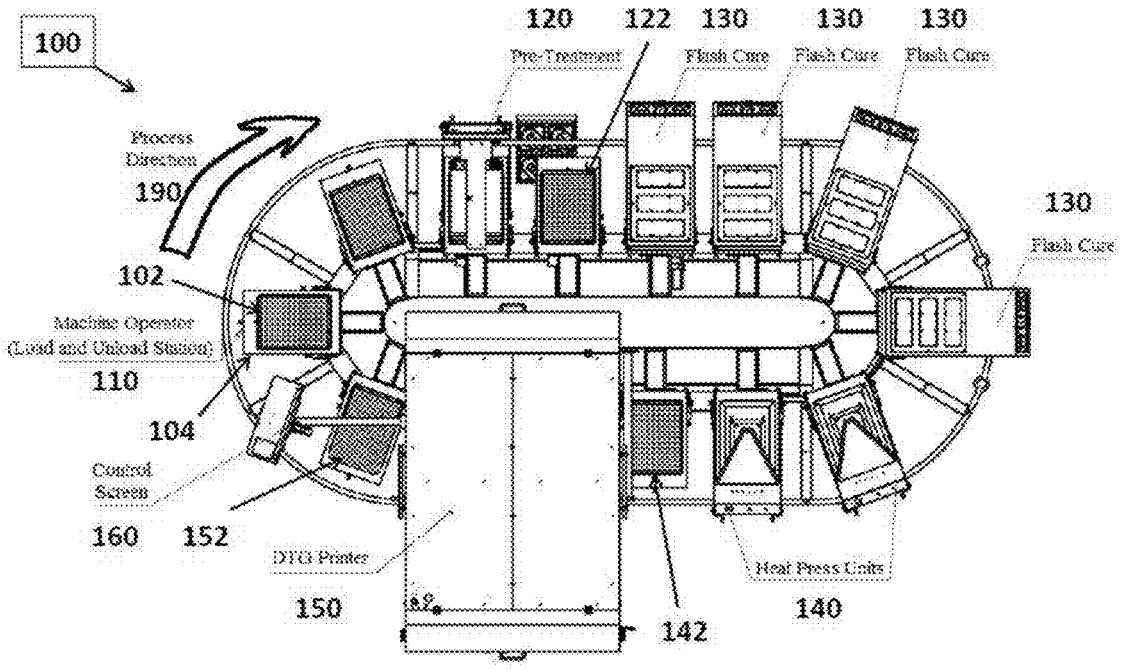
FIG. 1 is an overhead view of an apparatus for high-turnaround, closed-loop, direct to garment printing.
Figure 2:
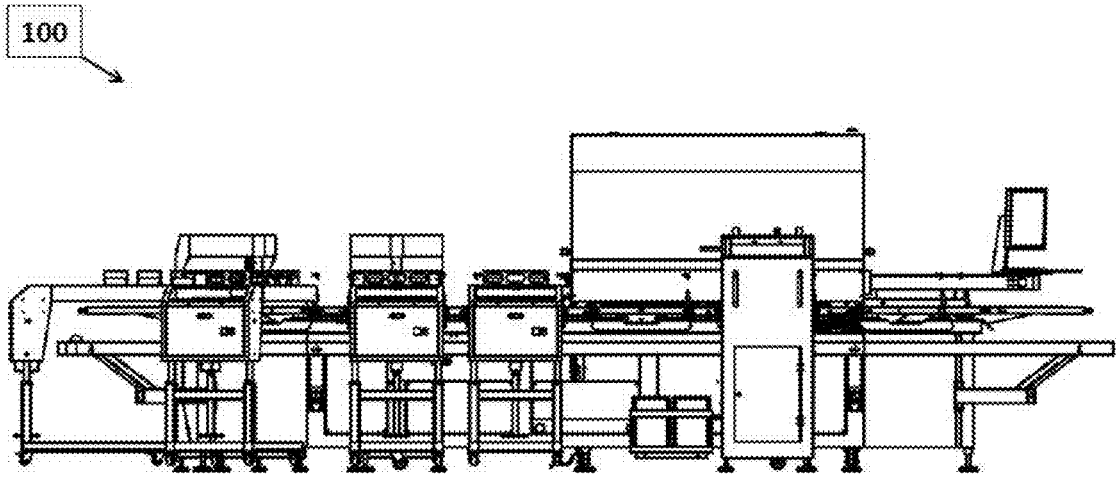
FIGS. 2-5 are side views of an apparatus for high-turnaround, closed-loop, direct to garment printing.
Figure 3:
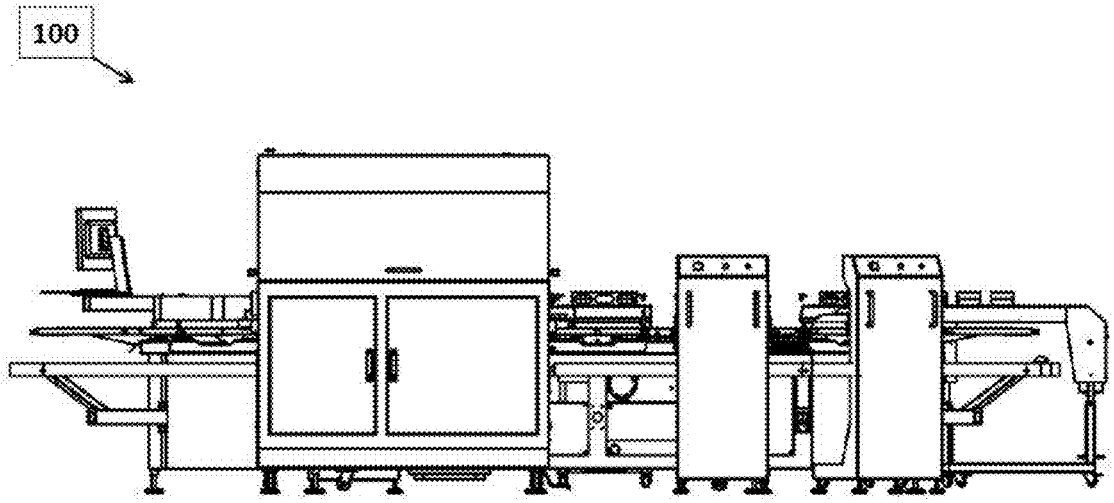
Figure 4:
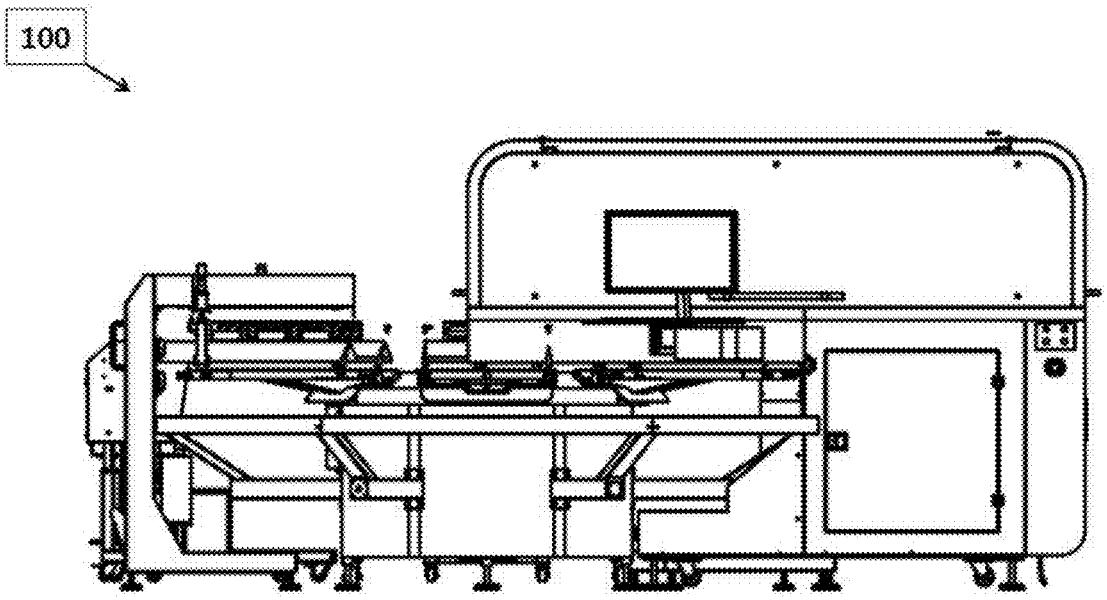
Figure 5:
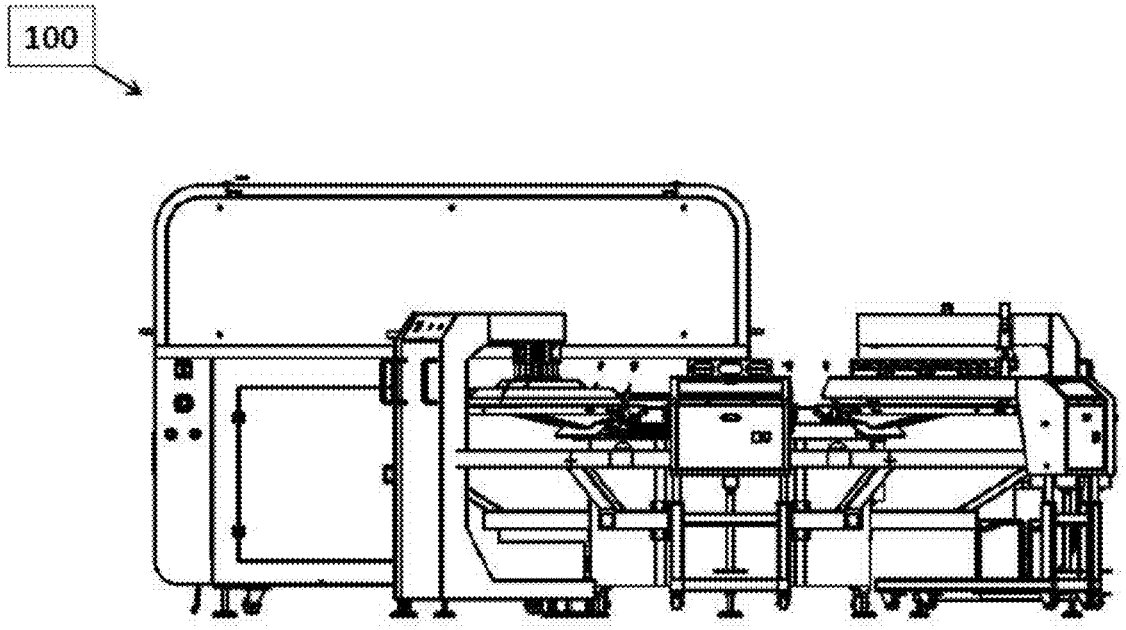
Figure 6:
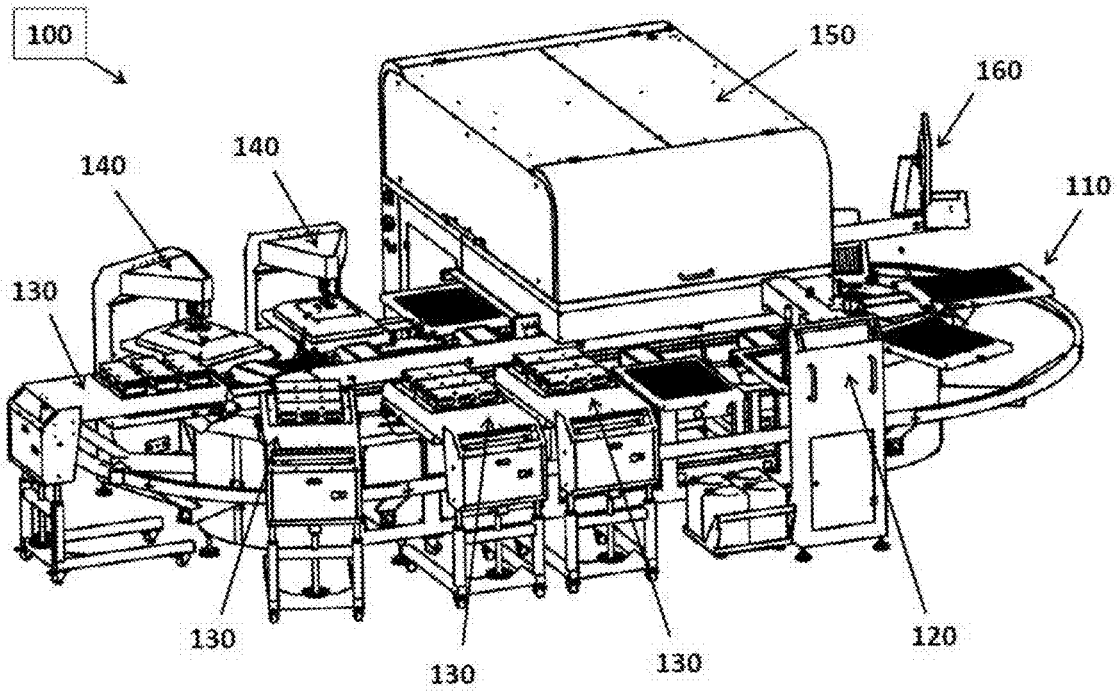
FIG. 6 is a perspective view of an apparatus for high-turnaround, closed-loop, direct to garment printing.

The invention provides systems and methods for high-turnaround, closed-loop, direct to garment (DTG) printing. Various aspects of the invention described herein may be applied to any of the particular applications set forth below. The invention may be applied as a part of a fabric production system. It shall be understood that different aspects of the invention can be appreciated individually, collectively, or in combination with each other.

Many different techniques are understood by those skilled in the art for transferring images onto fabrics, including, for example, screen printing, silk-screening, rotary multi-screen manual systems, automated silk-screening assembly lines, continuous rotating cylinder printing, heat transfer vinyl (HTV), transfer printing, inkjet printing, direct to garment (DTG) printing, and so on.

As mentioned above, recent technological improvements have adapted DTG printing to print very high quality, full color, photographic prints on just about any textile substrate (e.g., fabrics, canvas, tee shirts, etc.). However, inkjet printing on fabrics is still limited with regard to resolution and throughput, especially in combination.

For instance, DTG printing techniques often require pre-treating the substrate, particularly darker colored fabrics, with a chemical primer solution in order to achieve consistent and even printing. Proper application of the pre-treatment solution helps to obtain optimum absorption levels and ink adhesion to the fabric while also minimizing lateral bleeding, which may impact color, opacity, definition, and intensity.

Currently, pretreating techniques falls into two categories, referred to comparatively herein as "wet-on-dry" (WD) and "wet-on-wet" (WW). In wet-on-dry systems, the substrate is first pretreated either manually or by a pretreatment machine, and then dried, typically manually using a dryer and/or heat press. Later, the already pretreated (and dried) substrate is placed into the DTG printer for image printing with inks (hence "wet-on-dry"). In wet-on-wet systems, on the other hand, a printer typically first applies (e.g., by spraying) a pretreatment solution onto the substrate ("wet"), and then quickly (i.e., before it has a chance to dry) inkjet prints ("wet") the colored image onto the wet substrate. Wet-on-wet systems are generally fully integrated direct in-line processes, where an operator inserts an untreated garment, and then the pretreating and ink printing occur one after another within the same DTG printer. Notably, in both systems (WD and WW), it is common to first print a layer of white as a base layer upon which the colored image may then be printed.

Wet-on-dry systems are a multi-step process requiring time for drying between multiple stages of operation, often needing multiple workers or dividing a worker's time among different machines). WD systems generally also require storage of pretreated (and dried) garments and typically have a generically pretreated area on the garment (e.g., a full rectangle of "printable" area) regardless of the actual image to be printed. On the other hand, wet-on-wet systems may only be single-step processes (one worker inserting an untreated garment into the printer and removing a completed product). However, WW processes require very careful chemical coordination between the pretreat solution and ink and may still result in the two applications mixing together and smearing the printed image. Both systems also are designed for minimal production runs (e.g., typically up to 100 or so garments per customer order), since the DTG printers in both systems are only configured to print one (up to four) garments at a time (i.e., a worker places a garment in the printer, waits for it to print, removes the garment from the printer, inserts a new garment into the printer, waits for that garment to print, and so on).

One specific example embodiment herein, therefore, alleviates the concerns mentioned above, providing high-turnaround, closed-loop, DTG printing. Specifically, according to one or more embodiments as described in greater detail below, a high-speed, closed-loop (e.g., oval) fabric printer comprises a plurality of consecutive stations that can be managed by a single operator. As detailed below, fabric substrates, such as shirts or other fabric garments, may be individually loaded and secured on a pallet by the operator, and the loaded pallets then cycle through a plurality of unmanned stations positioned along a contiguous path. Any description of any type of fabric or garment, such as a shirt, may also apply to any other type of garment, such as pants, skirts, dresses, or undergarments. In some instances, garments may encompass accessories, such as bags, backpacks, belts, scarves, gloves, hats, or other items. For instance, the pallet assembly may allow for a garment, such as pants, skirts, or dresses, to be placed over a main print area, and a front part of the garment may be pulled down with aid of one or more positioning pins, to expose a back inner panel of the garment. In some instances, garments may include items with variable fabric thickness, such as hoodies, or garments with pockets or panels.

The stations may be configured for pretreating the fabric surface, drying and pressing the pretreated fabric with heat, and then inkjet printing a selected image, among others demonstrated further herein. In this manner, a newly established "wet-to-dry-to-wet" DTG printing process may thus be achieved. Due to the closed-loop design of the contiguous path (illustratively oval, although other options are also possible), a recently printed fabric product returns to the operator to be unloaded at the same or directly adjacent position in which a new unprinted fabric substrate (e.g., garment) is loaded, allowing for increased throughput and minimal operator requirements (e.g., single operator operation). This particular embodiment also provides for optimal controls and coordination between the stages of the system, allowing for maximum adaptability (e.g., for ink compositions, fabric materials, fabric thicknesses, image resolutions, and so on).

The pallet assembly may be configured to accept a garment. The garment may be any type or article of clothing, or any other type of textile product. The garment may be wearable over a torso of an individual. The garment may be a shirt, such as a T-shirt, dress shirt, tunic, bodysuit, or any other type of shirt. The garment may have no sleeves, straps, short sleeves, three-quarter sleeves, or long sleeves. The garment may have a neck tag area. The garment may have a collar. The garment may have one or more pockets or panels. The garment may be wearable over any other portion of an individual, such as legs, feet, or may be carried by an individual. The garment may be loaded onto the pallet assembly by inserting a metal print plate and/or substrate into the garment. A support may be inserted into the garment. Optionally, the support may comprise one or more pads that may be inserted into the garment. At least a printable surface of the garment may overly one or more portions of the support (and/or pads).

Reference is made generally to FIGS. 1-20 below, illustrating example embodiments of high-turnaround, closed-loop, direct to garment printing in accordance with various aspects of this particular, non-limiting, example embodiment.

In general, as shown, a single operator can both load untreated fabric substrates (e.g., garments) into the printing machine and unload printed garment products from the machine. Since the process is a continuously operating loop, pallets move between sequential stations, stopping at each for a preset period of time. Illustratively, the pallets move in tandem and the distance between consecutive stations is generally the same, such that the garment "sits" at each station for the same amount of time. Generally the dwell time at each process station may be dictated by a rate-limiting step of the overall process. However, this may not always be the most time-consuming step of the printing process, which is typically drying a treated/printed fabric. For example, the time spent at each station may generally be set by the amount of time needed to print the image on the garment, since increased need for drying time can be managed by increasing the number of drying stations positioned along the path, as discussed below.

The overall process begins with choosing a specific design for a final printed image, its features (e.g., colors, resolution, size, etc.), and a type of fabric garment on which the image is to be printed. These together typically dictate printing conditions (such as number of print passes, number and type of print heads, ink composition, pretreating conditions, etc.), which determine both the overall printing rate and the speed at which the garment passes through each station. Note that in certain embodiments, this may also affect the cost for the batch of final printed garments, as thicker fabrics or higher quality images will generally require more processing time and thus less of a throughput. For example, the garment may be made of a variety of different types of fabrics, such as cotton or synthetics, and may also vary in thickness and in size. Larger, thicker garments may require greater loading times, printing times, and/or drying times. In addition, the desired printed image, such as the image design, image size, color scheme, and the target location on the garment, may also impact the overall process time and the time spent within each process station. Note that pallet design may also be modified as needed for certain types of garments in order to improve overall process efficiencies.

Selected image details and printing conditions are programmed into a color printer, and a printing time is established. From this, the number and types of process stations along the continuous oval process loop can be determined, and each process station can be programmed to achieve a desired result within the established preset process station time, as described below. Once the printer is programmed, the dwell time in the stations is set, and the process stations are positioned, the overall continuous printing process can begin. In some instances, a pretreatment printer may be programmed along with an image printer (e.g. white and or color printer). The pretreatment printer may receive similar image formation as an image printer. In another embodiment, when an image printer is programmed, a pretreatment printer may automatically receive the same or similar data, which may allow the pretreatment printer to determine a pattern to print.

With reference to FIGS. 1-6, an illustrative printing apparatus 100 comprises a plurality of pallets that are movable through a plurality of stations. The pallets stop at each station for the determined dwell time. In particular, at operator station 110, an operator may load fabric substrate 102 (e.g., a garment, such as a t-shirt or sweatshirt) onto pallet 104 and secures it into place (such as by lowering a pallet frame, onto the garment and latching it into position). A pallet frame may optionally be provided. In some instances, the pallet frame may be a clamshell that may be rotatable about one or more axis. The pallet frame may rotate about a hinge. In other instances, the pallet frame may be a separate piece that may be manually or automatically lowered. The garment is positioned so that the surface onto which the image is to be printed is face up, thereby providing a window to access the printable surface. Optionally, the bottom of the garment may be closer to a hinge connecting a clamshell to a main print plate and/or substrate, while the top of the garment (e.g., neck tag area) may be away from the hinge. The clamshell may be configured to rotate about a hinge.

After the garment has been loaded onto the pallet assembly, the frame may be brought down to a closed position. The frame may be brought down manually with aid of an operator. In alternative embodiments, the frame may be brought down automatically with aid of an actuator (e.g., motor) or one or more unmanned devices. The frame may optionally be a clamshell.

In some alternative embodiments, a pallet may not have a clamshell. In some instances, alternative means may be used to fasten a garment or keep the garment at a desired position on the pallet. For instance, a sticky pallet, adhesives, or pallet with high frictional values may be used to keep a garment from slipping. In some instances, hook and loop fasteners or other fasteners may be used to secure a garment. In some instances, a static charge may be built or utilized to hold a garment stay in place on a pallet. One or more weights or magnets may be used to hold a garment in place. In some instances, this may be advantageous for items that may not fit well with a support or frame (e.g., backpacks, bags, or thick items). For instance, the support and/or one or more pads on a support may have a complementary shape relative to the garment. In such situations, a frame may not be attached to the pallet or may be removed from the pallet. In some situations, a frame may be folded in a manner so that it does not interfere with the process.

When the frame is completely closed, the garment may be secured to the pallet assembly. The garment may be prevented from slipping with respect to the pallet assembly. This may ensure that the garment is securely positioned, which can improve the quality of the images provided on the garment.

As a specific example, a shirt can be loaded, with the neck facing the operator stationed along the outside of the oval track. Smoothing of the printable surface can also occur, either automatically or manually by the operator, prior to securing the fabric in place. The garment may be pulled sufficiently down and flattened to prevent wrinkling or distortion of the front surface. The garment may be pulled down so that the shoulder regions of the garment contact the portion of the metal print plate and/or substrate. A collar of the garment may optionally be secured with aid of one or more positioning pins. The positioning pins may include one or more flange, lip, hook, or overhang. This may prevent the collar of the garment from slipping off the positioning pin. The shirt is loaded and secured at the operator station within the established process station time (the dwell time).

The garment may be loaded manually with aid of an operator. For instance, an individual may be located at an operator station 110 and may load and/or unload the garment. In alternative embodiments, the garment may be loaded automatically with aid of one or more unmanned devices. The pallet assembly may optionally be used in a closed-loop, direct to garment printing apparatus, as described elsewhere herein. In some embodiments, an operator may stand outside the loop, at an operator station. Alternatively, the operator may stand within the loop. The pallet assembly may be configured so that the frame (e.g., clamshell) opens in a manner so that the opening faces the operator. For instance, if an operator is outside the loop, the pallet assembly may be configured so that the frame opens up toward the outside of the loop. If an operator within the loop, the pallet assembly may be configured so that the frame opens up toward the inside of the loop. In alternative embodiments, the reverse may occur.

The resulting loaded pallet then passes, as shown by process direction arrow 190, from operator station 110 to one or more pretreatment stations 120. Once stopped at this station, another shirt may be loaded by the operator onto a subsequent empty pallet at operator station 110. At pretreatment station 120, a pretreatment fluid (e.g., a pretreatment solution, such as an acidic pretreatment) can be applied to the target printable surface as needed. The amount of pretreatment, type of solution, and method of application can be varied depending, for example, on the type of garment, the type and color of fabric, and the image design. For example, for a white or light colored cotton tee shirt, no pretreatment may be needed, depending on ink compositions and fabric type, but for darker colors or thicker fabrics, pretreatment may be preferred. In some embodiments, pretreatment occurs using a nozzle sprayer to apply an acidic pretreatment solution to the printable surface. Alternatively, the acidic pretreatment solution may be applied using a screen printing techniques. However, nozzle spraying may be preferred since screening methods generally require refilling of the solution reservoirs after application, which would necessitate the addition of another operator or at least would require attention from the loading/unloading operator. In addition, nozzle spray printing enables targeting of specific portions of the printable surface so that only the areas that require pretreatment (e.g., the areas to which the target image will be printed) receive treatment. For either method, a single pass is often sufficient to apply the pretreatment solution to the printable surface. In this way, pretreatment can occur in the required process station time, thereby enabling higher speeds of the overall process. However, if more time is needed to apply the required amount of pretreatment, such as for thicker fabric garments, rather than increasing the dwell time at the station (which would necessarily increase the time in all stations), one or more additional pretreatment stations may be added, thereby having minimal impact on the overall process timing.

The pallet containing the resulting fabric substrate having the pretreated printable surface 122 (e.g., a pretreated fabric garment) then passes to one or more heating stations 130 (e.g., flash drying stations) at which heat is applied to dry and set the pretreatment. Any flash drier known in the art may be used, including those used to dry silk screened images. For example, in some embodiments, the flash drier includes an infrared heater. The number of flash drying stations depends, for example, on the type of fabric, the drying temperature, and the amount of time needed to thoroughly set and dry the pretreated fabric at that temperature. These may be determined experimentally or estimated empirically. The required drying time is then compared to the previously determined constant dwell time to be spent at each process station, and the number of needed flash driers can then be determined. For example, for drying a single-pass nozzle-pretreated cotton shirt at a preset temperature, four sequential flash drier stations may be used, as shown in FIGS. 1-6. Each heating station 130 may be programmable so that the temperature can be turned on prior to the pallet entering the station or may employ a temperature ramp to reach the desired drying temperature within the preset time. Also, each station may flash dry and set the pretreated fabric at the same average temperature, or each stage may use a different temperature, such as increasing or decreasing temperature steps, to achieve efficient heating without damage to the fabric.

As an illustrative example, assume that printing a target image on a t-shirt (at a later stage in the process, although a stage that another previously loaded t-shirt may currently be undergoing) takes 10 seconds. To ensure proper drying of the pre-treatment solution, it may be determined that, at a specified temperature X, it would take approximately 40 seconds to apply the desired amount of heat. As such, assuming the t-shirt dwells at each station for only 10 seconds (as dictated by the printing time), one solution would be to use four flash cure stations (10 seconds for 4 stations equals 40 seconds). Alternatively, heat may be increased and fewer flash cure stations may be used (e.g., 3 stations for a total of 30 seconds, at a higher drying temperature). Other combinations will be readily apparent to those skilled in the art, and those mentioned herein are merely for illustration of the adaptiveness of the system described herein.

After flash drying, the pallet containing the fabric substrate having the dried pretreated printable surface (e.g., a dried pretreated fabric) may then pass to one or more optional hot press stations 140 at which, during the pre-established station dwell time, the fabric fibers are pressed in preparation for image printing. The number of hot press stations can be varied, depending, for example, on the temperature of the hot press and on the number of flash drying stations (e.g., the extent of drying of the pretreated fabric). It has been found that by using one or more hot press stations as an additional heating station for further heating and drying the pretreated fabric, overall drying time can be significantly reduced (e.g., one third the dry time required by only flash curing the garment), thereby improving efficiency and overall production speed, in addition to stretching and pressing the fibers of the fabric (which makes for better printing).

In this specific embodiment, the pallet containing the resulting fabric substrate having the pressed dried pretreated printable surface (e.g., a pressed dried pretreated fabric) then passes to one or more printer stations 150, such as a DTG printer, where ink is applied to produce the printed fabric product including the desired image. While many different types of printers may be used, in some embodiments the printer comprises an inkjet printer, which may be any inkjet printer known in the art. Inkjet ink compositions may be white or color inks (such as cyan, magenta, yellow, or black), including pigment based or dye based colorants, and are formulated for the particular type of print head and nozzles in order to enable high speed printing of the chosen image onto the pressed dry pretreated fabric.

The number of print heads and nozzles may be chosen as needed in order to provide a final printed image in a time that is less than or equal to the preset station dwell time, as discussed in more detail herein. In particular, the number of print heads may be chosen to ensure that the entire image is capable of being printed in a single pass within the preset time. However, for some image designs, resolutions (e.g., higher dots per inch (DPI)), and fabric types, multiple passes of the print head may be needed. Multiple passes would either require increasing the station dwell time, which would reduce overall throughput (e.g., 50 garments per hour), especially for large batch operations, since all stations (e.g., pretreatment, flash drying, and hot pressing) would also include the increased time, or, alternatively, would produce a lower quality final printed image (durability, clarity, etc.) if a single pass is used (e.g., 300 or more garments per hour). Notably, as mentioned above, in some embodiments, the print station dictates the time spent at each station (the dwell time), and as such, also dictates the amount of heat that needs to be applied (temperature and/or number of heat/cure stations) in order to dry the pre-treatment solution sufficiently enough to be ready for printing.

Figure 7:
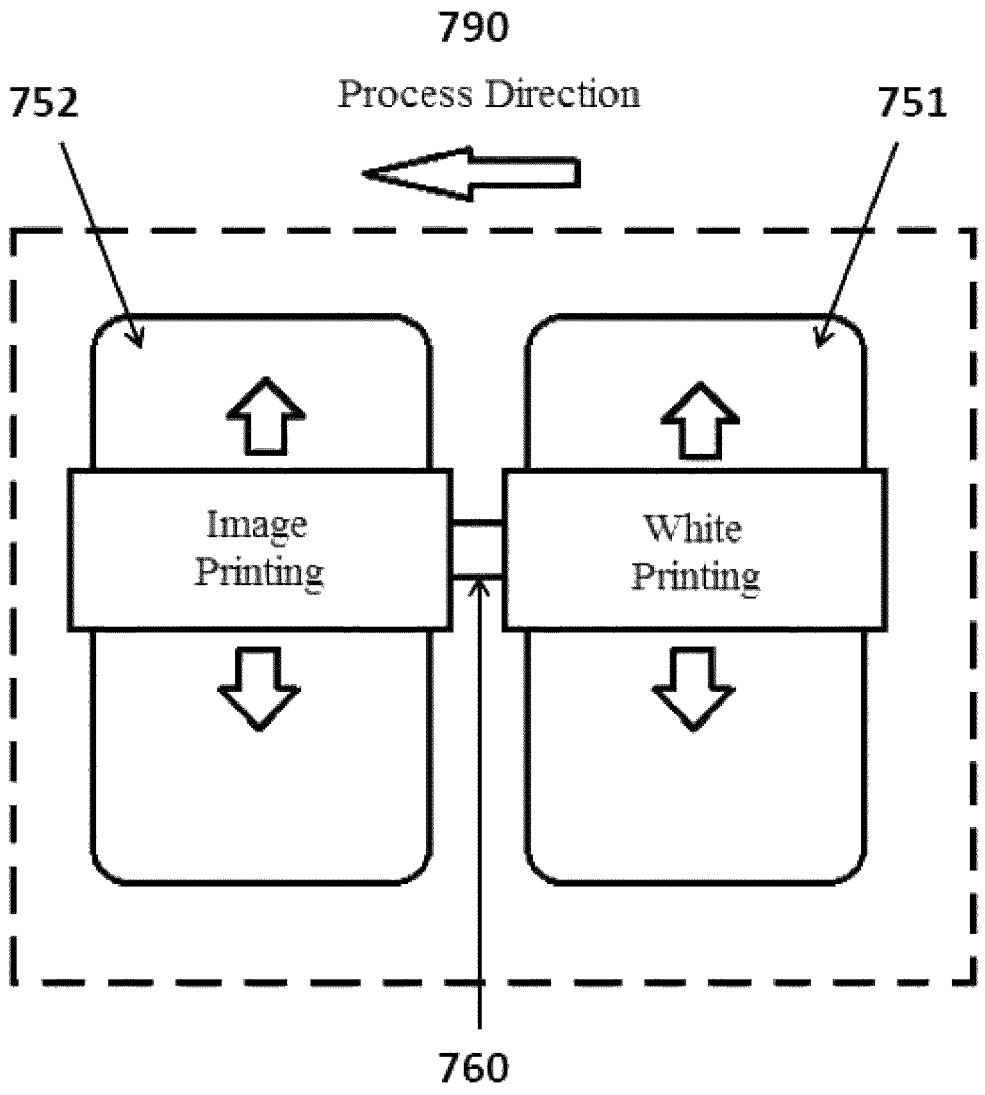
FIG. 7 is an example simplified view of a printer stage of an apparatus for high-turnaround, closed-loop, direct to garment printing.

Therefore, in order to achieve high throughput in a single pass, based on the techniques described herein, it has been found that multiple consecutive printer stations can be used, with each station being configured to print a specific type of ink within the preset station dwell time. For example, as shown in FIG. 7, in some embodiments, the pallet containing the pressed dry pretreated fabric may pass in direction 790 through two consecutive and adjacent printer stations, 751 and 752. First printer station 751 may include an array of print heads configured for printing a first inkjet ink, and second printer station 752 may include an array of print heads configured for printing a second inkjet ink. In some embodiments, the array of print heads are linear (such as a linear array of eight print heads), and each array having a length that spans across the entire print area (e.g., across the width of print area of the fabric garment).

The print head of the first station may move independently of the print head of the second station, or, alternatively, the print heads of each station may be configured to move in tandem (e.g., on a single controlled arm 760). For example, the print heads of consecutive printer stations may be mechanically coupled so that a single pass may be made for all print heads while sequential pallets are positioned in adjacent printer stations. Note that, in this configuration, the print heads of each station need not apply ink on each "pass". For example, if six passes at the first station are required, but only four passes at the second station are required, the ink jets of the second station may be configured to not apply ink for at least two of the passes. The same arrangement is possible in reverse as well: that is, fewer ink application passes on the first station than the second station. This would be expected to significantly simplify the mechanical design and operation of the printer, saving on space, efficiency, and cost.

As shown in FIG. 7, in a specific embodiment, the first printer station may be configured for printing a white inkjet ink, and the second printer station may be configured for printing colored inkjet inks. In this way, a white base may be printed onto the pressed dry pretreated fabric within the preset time of a single stage, which is then followed by printing of the color regions needed to complete the target image, also within the preset time and within a single stage. Accordingly, the white ink composition may be specifically formulated to dry (set up) quickly in order to allow proper application of the colored image at the next printing station. In some embodiments, a colored image may be applied over the white ink image without requiring additional steps in between the two stages. Alternatively, additional steps and/or stations, such as flash and/or heat press processes may be provided between printing the white image and the colored image.

Illustratively, as shown in FIG. 7, in order to achieve the desired result in a single "back and forth" motion, the print heads for both the white and color stages may be arranged width-wise to cover the entire desired print area (e.g., a 16" inch array width), such that one or more back and forth passes (e.g., 20" up and back) will complete the desired printing process of the entire image without any "side to side" motion required to reposition the print heads. Note that although conventional DTG printers today typically perform around 32 "passes" (printer head passes over the garment) with white ink and 16 passes with color ink, due to the number of print head repositions, the techniques herein and the specifically configured print heads may create the same or better quality images with only 4-10 total passes (depending upon desired level of resolution).

Notably, when the first printer station (e.g., white ink) immediately follows a heating station, such as a heat pressing station, advantages may be gained by the garment still being warmed. That is, the pressed dry pretreated fabric may still be warmed due to time since the last heating of the garment, in addition to the general warming of the pallet (e.g., a metal pallet) holding the fabric over continued processing time. The white ink, printed on the heated surface, would therefore set faster (compared to being printed on a cool pre-dried surface), providing a cured surface for the color printing and increasing the speed of the overall printing process.

As mentioned above, if additional ink is needed in order to achieve the desired print quality, adjacent parallel print heads may be included in a printer station, such as an array of sixteen print heads, formed by adjacent and parallel linear arrays of eight print heads. Each linear array can be configured to print the desired color and/or combinations of colors needed to achieve the desired print quality. By using parallel arrays of print heads, additional ink can be applied without adding additional printer stations or increasing the printing time that would thereby increase the preset dwell time in each station. Illustratively, for example, if more white ink is needed for the base coat prior to printing the color image, sixteen print nozzles (e.g., two rows of eight) may be used on the white print head, and eight nozzles (e.g., a single row) may be used on the color/image print head, thus providing for twice as much ink application of white versus color within the same number of (illustratively tandem) passes of the print heads.

After the image print is complete, the pallet containing the printed fabric garment may, if needed, further pass to one or more optional heating stations to cure and set the printed image. Any of the heating stations, including the flash dry stations described above, can be used.

Figure 8:
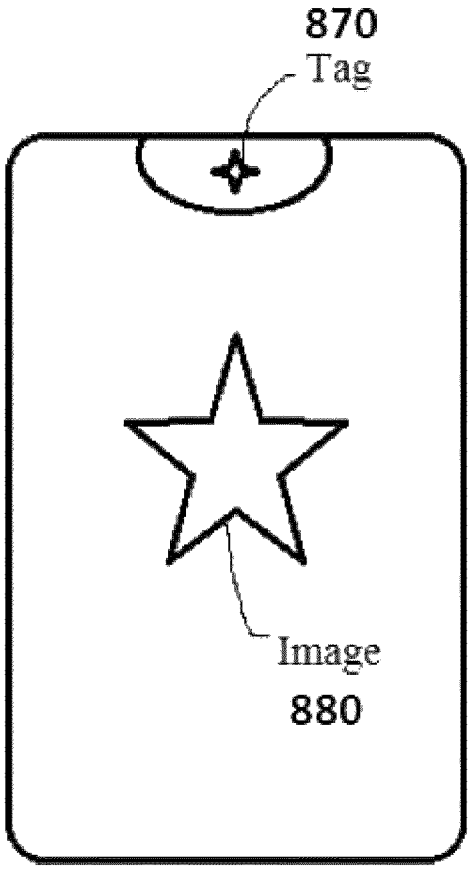
FIG. 8 is an example garment on a pallet of an apparatus for high-turnaround, closed-loop, direct to garment printing.

For example, as shown in FIG. 8, in certain embodiments, the pallets may be configured to allow simultaneous print access to both the garment image-printable area and the "tag" located inside of the garment at the neck (as will be understood by those skilled in the art). For instance, many garments now replace the conventional "sewn-in" tag (manufacturer information, wash instructions, etc.) with a printing of the information. With an advanced pallet design that exposes this tag area in addition to the primary image area, the printers may be further configured to print tag 870 at the same time as image 880. In such, configurations, it may be beneficial (or required) to add one or more drying stations (e.g., one or more flash cure stations) in order to ensure that the printed neck tag has dried sufficiently enough to allow the opposing portion of the garment (e.g., the top of the shirt) to touch the neck tag without smearing it.

As shown in FIGS. 1-6, the pallet containing printed fabric product 152, in some embodiments, may then return to operator station 110, completing the circuit around the illustratively oval loop. There, the final printed fabric garment can be removed from the pallet, and a new, untreated garment can be loaded, beginning the process loop again. Note that in certain embodiments, the operator may move the garment into a follow-on drying station in order to fully cure the printed image(s), if needed. Alternatively, the pallet may return the final printed garment to a position adjacent, and within reach of, the operator at the operator station. In addition, information regarding overall process conditions and status may be provided to the operator by control screen 160. Thus, as can be seen, the entire process can be managed by a single operator, linking the components of the printing apparatus together in a customizable and programmable manner (e.g., heat, dwell time, print passes, etc.).

In some instances, an operator may manually enter information via the control screen. For instance image data may be accessed or provided via the control screen. Any description herein of image data may encompass an image printed on any printing area, such as a main print area and/or an image printed on a neck tag area. A print area may be on a front, back, sleeve, or any other portion of a garment. Any description herein of an image may include pictures, characters (e.g., letters, numbers), symbols, code, or any other design that may be printed. In some instances, the operator may enter information, such as the dwell time, heat (e.g., temperatures, number of stations, etc.), print passes (e.g., number of print passes, arrangement of printing stations, pretreatment requirements), and so forth. The operator may base this information on the fabric and/or the image to be printed. In other embodiment, the operator may enter information about the garment fabric, and the system may automatically determine information, such as the dwell time, heat (e.g., temperatures, number of stations, etc.), print passes (e.g., number of print passes, arrangement of printing stations, pretreatment requirements), and so forth. The system may utilize algorithms that may determine printing details, such as dwell time, heat, print passes, etc. based on the fabric and/or the image to be printed. One or more computer systems may be utilized to help determine and/or control operation of the apparatus and stations.

Figure 9:
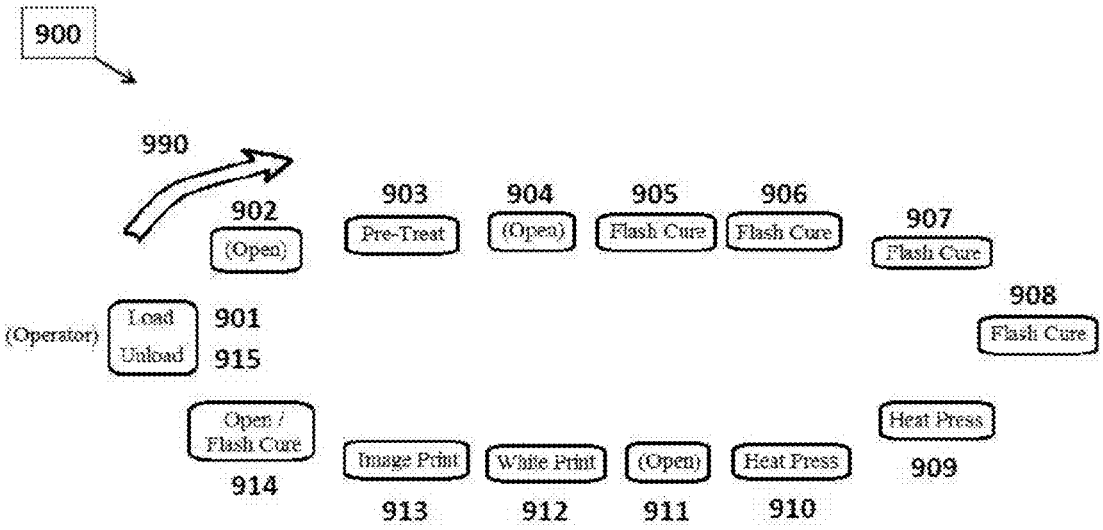
FIGS. 9 and 10 are an example simplified view of stages of an apparatus for high-turnaround, closed-loop, direct to garment printing.
Figure 10:
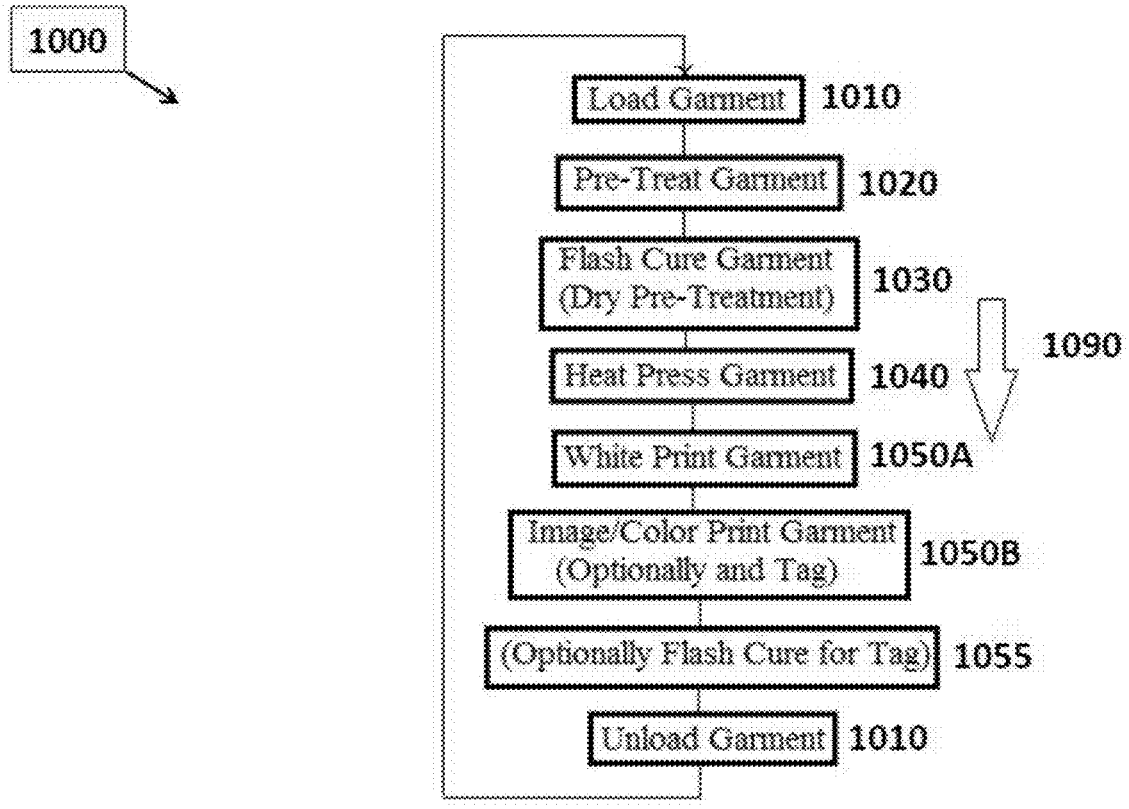

FIGS. 9-10 illustrate example procedures for high-turn-around, closed-loop, direct to garment printing in accordance with one or more embodiments described herein. For example, the steps shown may be configured for operation on the printing system described above, and controlled by a computing system which may perform the procedures by executing stored instructions.

For example, FIG. 9 illustrates general procedural steps for the illustrative system described above, with a plurality of sequential stations (such as multiple flash cure stations, and so on) at which a substrate stops for a predetermined dwell time. In particular, as shown, procedure 900 begins at operator station 901 at which an operator loads a fabric substrate onto a pallet. The loaded pallet may then move in direction 990 to first open station 902 and subsequently to pretreatment station 903 at which a portion of the printable surface of the fabric substrate may be treated, as described above. Open stations/positions may be desirable based on the distance between adjacent pallets and the relative locations of each station. After pretreatment, the pallet may then move through second open station 904 and subsequently through a series of heating stations, including flash cure stations 905-908 and heat press stations 909-910 during which the pretreated substrate surface may be dried and pressed, readied for printing. After passing through third open station 911, the pallet may then move through printing stations 912 and 913 for white and color image printing respectively. The resulting printed product may then pass through station 914, which may be an open position or a flash cure, as desired. Procedure 900 then ends at operator station 915, where the printed fabric product is unloaded. As shown, this is the same operator station where procedure 900 began.

Alternatively, FIG. 10 illustrates a more generic view, where an exact number of stations is not specifically shown, demonstrating the generalized configurability of the system described herein. As shown, procedure 1000 proceeds in direction 1090 includes operator station 1010 at which a garment may be loaded, pretreatment station 1020 to pretreat at least a portion of the area to be printed on the garment, heating stations 1030 and 1040 to flash dry and optionally hot press the pretreated garment (respectively), and printing stations 1050A and 1050B to print the image white and color ink on the pretreated portion of the garment. Optionally, at the printing station, a tag for the garment (e.g., a shirt tag) can also be printed, which can subsequently be dried at flash cure station 1055. Finally, the printed garment product may be unloaded at operator station 1010, and the process may begin again. Alternatively, in some embodiments, unloading may occur at a different operator station substantially adjacent to the station used for loading.

Figure 11:
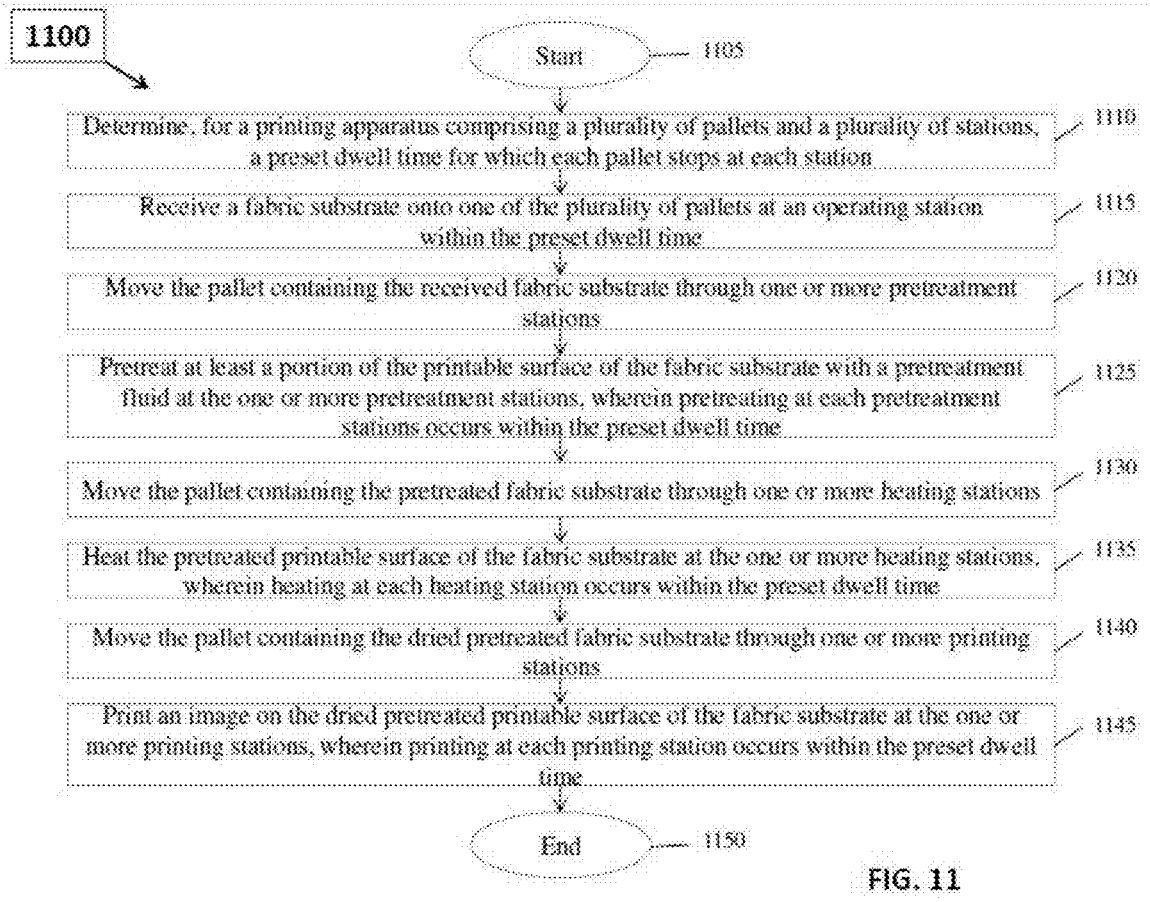
FIG. 11 shows an example simplified procedure for direct to garment printing.

FIG. 11 illustrates an example simplified procedure for direct-to-garment printing, in accordance with one or more embodiments described herein. For example, a non-generic, specifically configured device (e.g., a controller) may perform procedure 1100 by executing stored instructions. The procedure 1100 may start at step 1105, and continues to step 1110, where, as described in greater detail above, a preset dwell time is determined for a printing apparatus having a plurality of pallets that are configured to secure a fabric substrate having a printable surface and that stop at a plurality of stations positioned along a closed-loop path of the printing apparatus. The fabric substrate (e.g., a garment, such as a tee shirt or sweatshirt) is secured in the pallet to provide access to the printable surface of the substrate upon which a chosen image is to be printed. Each pallet stops at each of the stations for the preset dwell time. The dwell time may be determined based on a rate-limiting step of the process (e.g., the station requiring the most time for the fabric substrate operation) or may be determined based on which step requires more time and cannot be repeated in subsequent stations. In some embodiments, the dwell time may be pre-established/preset based on the time needed to print the chosen image on the fabric substrate.

At step 1115, the fabric substrate may be received on one of the plurality of pallets at an operator station within the preset dwell time (thus loading the fabric substrate at the operator station, such as by an operator). As described in greater detail above, loading and optionally further securing of the fabric substrate occurs within the determined preset dwell time in order to provide access to the printable surface of the fabric substrate. In some embodiments, this station may be the only manned station of the printing apparatus.

At step 1120, the pallet containing the received fabric substrate may move (e.g. sequentially) through one or more pretreatment stations. For example, as described in greater detail above, the loaded pallet may pass from the operator station to a pretreatment station comprising a nozzle jet printer configured to print an acidic pretreatment solution. Intervening open stations may also be included as needed, depending on the position of the pretreatment station and the distance between pallets.

The pallet assembly may be configured to support a garment while the garment traverses a printing apparatus. An arm may be coupled to the pallet assembly. The arm may be an elongated structure. The arm may have an axis extending along the length of the arm that may coincide with or be parallel to an axis extending along a length of the pallet assembly. The arm may support the pallet assembly. The arm may be configured to bear the entire weight of the pallet assembly, or a portion of the weight of the pallet as-sembly. The arm may aid in keeping the pallet assembly aligned in a desirable manner as the pallet assembly may traverse the printing apparatus. The arm may or may not be con-figured to allow the pallet assembly to move relative to a longitudinal axis of the arm. One or more sliding or telescoping mechanism may be provided that may allow a pallet assembly to move longitudinally. Alternatively, the arm may have a fixed length and/or the pallet assembly may have a fixed position relative to the arm. The pallet assembly may be permanently affixed to the arm, or may be repeatedly removable relative to the arm. This may be useful when it is desirable to switch in different types of pallet assemblies that may have different features. This may provide additional flexibility to the printing apparatus. For instance, different pallet assemblies having different dimensions, materials, shapes, locations of printing regions, accommodating for different types of garments, or other features may be provided. A removable pallet assembly may be affixed to an arm or other support with aid of one or more fasteners. In some instances, a quick release assembly may be utilized. A quick release mechanism may allow the pallet assembly to be removed or added without requiring additional tools. A user may manually add or remove the pallet assembly manually by hand (e.g., with less than or equal to one motion, two motions, three motions, or four motions).

One or more additional supporting features may be provided. Additional supporting features may aid in bearing weight of the pallet assembly, providing alignment for the pallet assembly, and/or aid in causing the pallet assembly to traverse the printing apparatus.

The arm and/or supporting features may be part of the printing apparatus. The arm and/or supporting feature may be coupled to an actuator, or may be coupled to a movable portion of the printing apparatus, that may allow the pallet assembly to traverse the printing apparatus.

One or more supporting features may be provided. The supporting feature may in-clude a plate that may extend substantially perpendicularly or transversely with respect to the arm. The supporting feature may be coupled to the arm and/or configured to interface with the rest of the printing apparatus. The supporting feature may bear the weight of the entire arm or a portion of the weight of the arm.

One or more vibration dampeners may be provided on the support feature. This may allow the arm and/or pallet assembly to remain relatively steady as they traverse the printing apparatus. This may reduce the vibrations experienced by the pallet assembly which may reduce inaccuracies while printing an image on a garment supported by the pallet assembly. The vibration dampeners may reduce vibrations experienced in a vertical direction. Similarly, vibration dampeners may be provided that may reduce vibrations ex-perienced in a lateral direction. The vibration dampeners may include one or more sets of springs, pneumatic or hydraulic pistons, or any other structure.

At step 1125, as described in greater detail above, at least a portion of the printable surface of the fabric substrate may be pretreated with a pretreatment fluid at one or more of the pretreatment station, resulting in a fabric substrate having a pretreated printable surface. In some embodiments, pretreatment may occur in a single pass, although multiple passes may be needed, depending on the size of the printable area and the type of fabric. However, as described above, pretreating occurs at each of the pretreatment stations within the preset dwell time. If additional time is needed, an additional pretreatment station may be included.

At step 1130, the pallet containing the fabric substrate having the pretreated printable surface may move (e.g. sequentially) through one or more heating stations. As described in greater detail above, the number of heating stations can vary, and, in some embodiments, 2 to 5 heating stations may be used, each programmed to heat at the same or different temperature and/or rate. In particular, a certain number of heating stations may be configured, where the certain number is selected based on the amount of time needed to dry the pretreated surface and/or the chosen drying temperature, while only drying at any one heating station within the preset dwell time, as described above.

At step 1135, in some embodiments, the pretreated printable surface of the fabric substrate may be heated at the one or more heating stations, resulting in a fabric substrate having a dried pretreated printable surface. As described in greater detail above, heating at each of the heating stations occurs within the preset dwell time. The heating stations may include various types of heaters, including, for example, infrared heaters. Also, optionally, one or more of the heating stations may comprise a hot press to both heat and smooth the pretreated surface.

At step 1140, as described in greater detail above, the pallet containing the fabric substrate having the dried pretreated printable substrate may move (e.g., sequentially) through one or more printing stations. In some embodiments, multiple printing stations may be used, such as to provide a white printed image first and a color printed image on or with the white image.

At step 1145, the chosen image is printed on the dried pretreated printable surface of the fabric substrate at one or more printing stations to form a printed fabric product. In some embodiments, at least one of the printing stations comprises an inkjet printer. For example, white inkjet ink may be printed onto the fabric substrate surface followed by printing of color inkjet ink, to form the chosen image. Thus, each of the one or more printing stations may print a respective portion of the image. The print heads may be coupled to reduce mechanical complexity within the print stations. However, as described in greater detail above, printing occurs at each of the printing stations within the preset dwell time. The printed fabric product may then be unloaded at the operator station. Optionally, the printed image may be dried, such as in a hot press, prior to unloading. Procedure 1100 then ends at step 1150.

It should be noted that certain steps within procedures 900, 1000, and 1100 may be optional as described above, and the steps shown in FIGS. 9-11 are merely examples for illustration, and certain other steps may be included or excluded as desired. Further, while a particular order of the steps is shown, this ordering is merely illustrative, and any suitable arrangement of the steps may be utilized without departing from the scope of the embodiments herein. Moreover, while procedures 900, 1000, and 1100 are described separately, certain steps from each procedure may be incorporated into each other procedure, and the procedures are not meant to be mutually exclusive.

Figure 18:
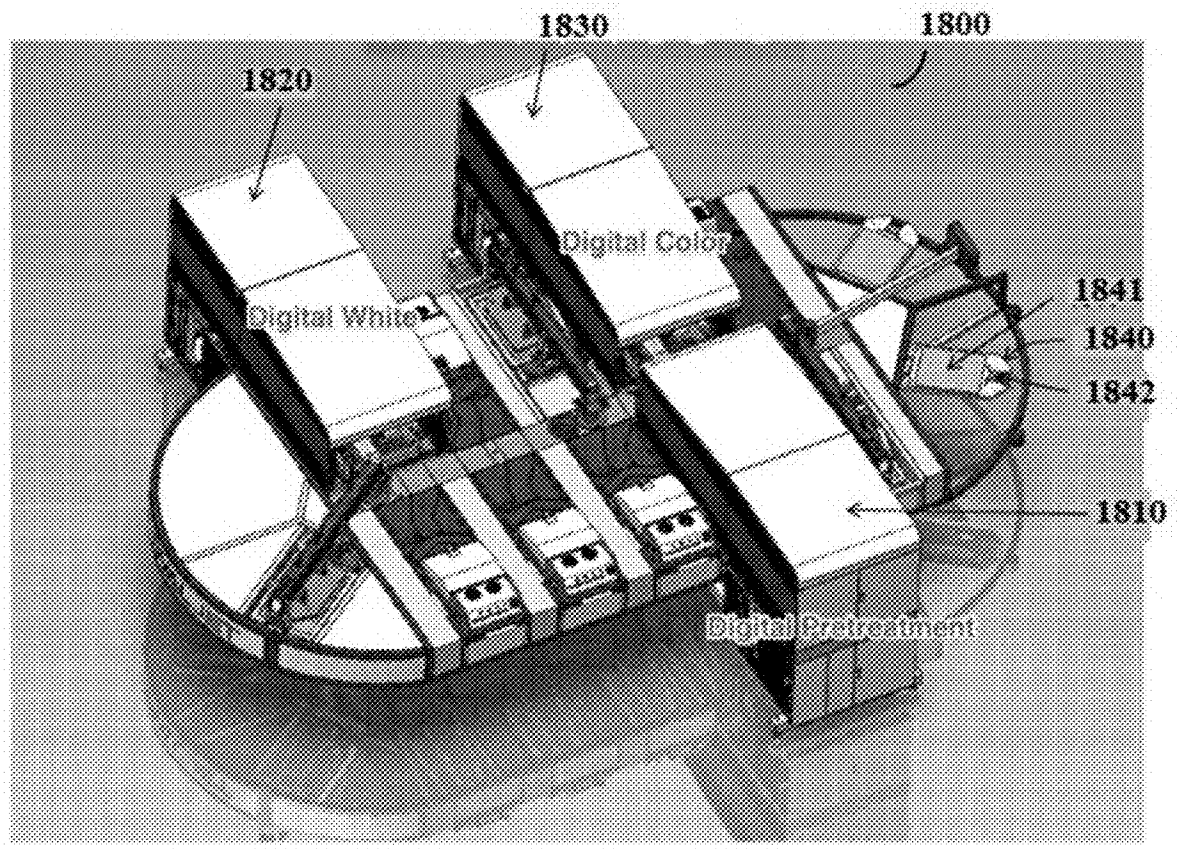
FIG. 18 shows an example of an apparatus for closed-loop, direct to garment printing, including at least one digital pretreatment station, and at least one print station.

FIG. 18 shows an example of an apparatus for close closed-loop, direct to garment printing 1800, including at least one digital pretreatment station 1810, and at least one print station 1820, 1830. One or more pallets 1840 may traverse the closed-loop, direct to garment printing apparatus. The pallets may be reconfigurable as provided in greater detail outlined herein. Optionally, the pallets may be neck tag pallets that may include an exposed main print area 1841 and neck tag area 1841, which may be at the same level. Alternatively, any other pallet configuration may be used.

As described elsewhere herein, nozzle jet printers may be used at the one or more digital pretreatment stations and/or the one or more print stations. In some embodiments a separate digital white print station 1820 and digital color print station 1830 may be provided. A heating station may or may not be provided between the digital white and digital color printing station. Alternatively, both the white printing and the color printing may be provided at a single station.

The nozzle jet printer of the pretreatment station may operate similarly to the printers of the white and/or color printing station. Any description herein of a nozzle jet printer may apply to any type of printer that may be utilized to print white and/or color images. For instance, a spray nozzle may be used. In other instances, a drop-on-demand (DOD) print head may be used. For example, valve jet print heads, such as REA JET DOD 2.0 may be used, or may share similar characteristics. The nozzle jet printer may print digital images on the garment. The nozzle jet printer may include a single nozzle, a row or column or nozzles, or an array of nozzles that may digitally print on the underlying garment. In some instances, 1 or more, 2 or more, 4 or more, 8 or more, 16 or more, 32 or more, 64 or more, or any number of nozzles may be provided. The nozzles may be used to print pretreatment solution in the same pattern as the image. In some instances, a single pass of a carriage head may be sufficient to print the pre-treatment solution. Alternatively, multiple passes may be provided. This may advantageously minimize waste of pretreatment solution, and/or ensure that fabric without the image remains as solution-free as possible. Data about the image to be printed may be provided to the pretreatment station, which may allow the nozzle jet printer to be controlled to print only the same pattern as the image.

In some instances, one or more printers, (e.g., two or more valve jet printers) may be used to print pretreatment in the same "dot for dot" pattern as the image. This may allow the printing apparatus to use a pretreatment liquid that has a higher concentration of binder, since the process is no longer concerned with defects that may be associated with spraying an entire surface of substrate (e.g., staining, dye migration, color shift).

The dot size and/or dot pressure may be controllable. For instance, one or more) ML commands may be provided that may indicate desired dot size and/or pressure. This may allow the systems and methods to lay down variable drop volume for different substrate thicknesses or other material properties. The result may be to take a slightly viscous/resinous material and coat fibers until a point of saturation is reached. Then the material may be cured to create a new ink-receptive 'film' that sits on top of the substrate. When printing on the film, there is less concern about the chemical properties of the substrate, since a new thin and stable substrate has been created to be printed upon, by undergoing the pretreatment process.

A nozzle jet printer for the pretreatment station may optionally operate at any desired degree of resolution. For instance, the pretreatment solution may be laid down with at least a 60 dpi, 90 dpi, 120 dpi, 150 dpi, 200 dpi, 300 dpi, 400 dpi, 600 dpi, 900 dpi, 1200 dpi, 1800 dpi, 2400 dpi, 3000 dpi, or greater, resolution.

When the pallet and garment subsequently travel to a printing station, the images may be printed directly over the pattern laid down at the pretreatment station. The jet printers at subsequent printing stations may receive data about the image to be printed. In some instances, the white ink may be laid down first, before adding the color. The printers at the print stations may operate similarly to the printer at the pretreatment station. They may operate with the same degree of resolution and/or speed. Alternatively, there may be one or more different characteristics between the pretreatment printer and the print station printers.

Figure 17:
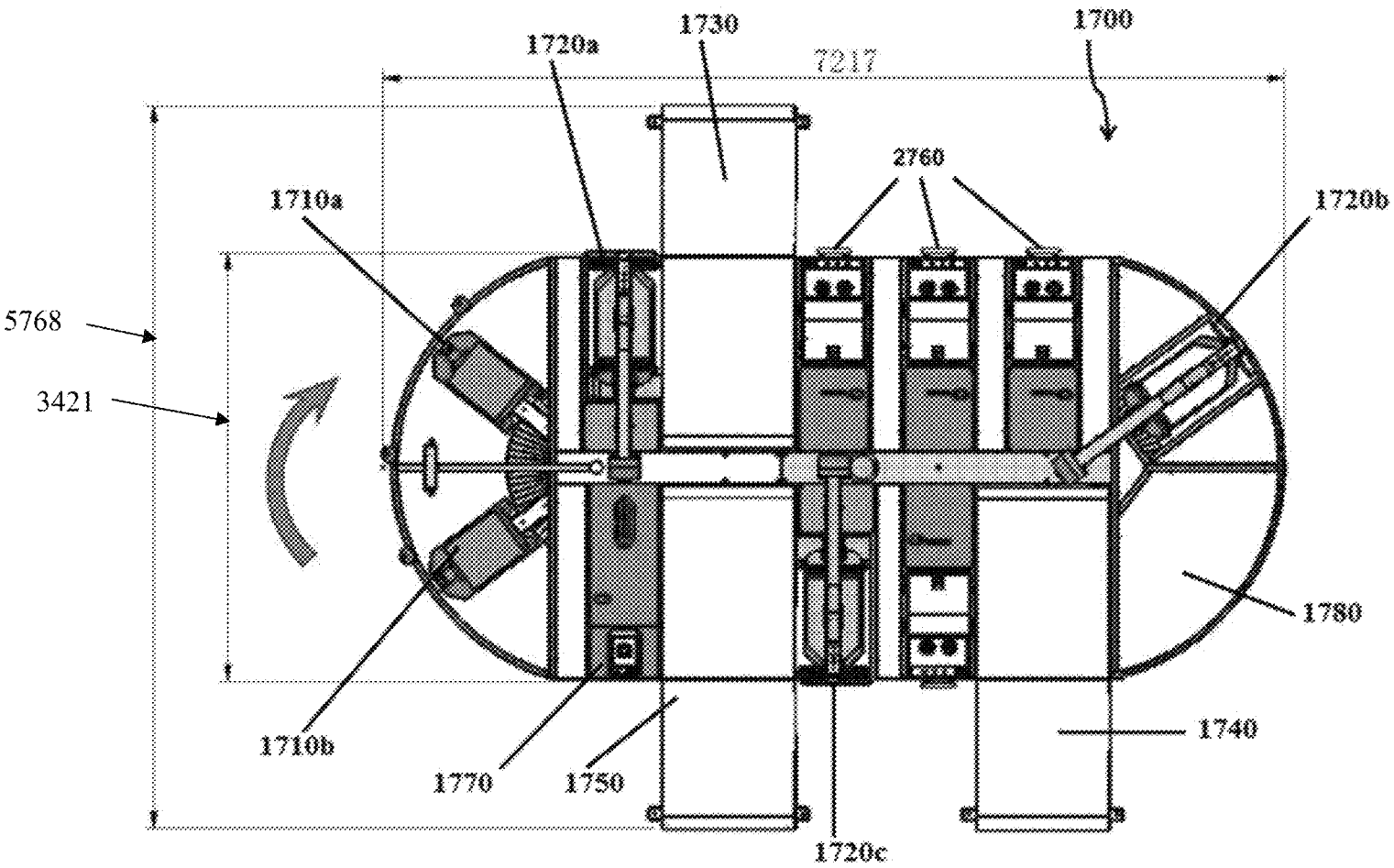
FIG. 17 shows a top view of a closed-loop, direct to garment printing apparatus.

FIG. 17 shows a top view of a closed-loop, direct to garment printing apparatus 1700. Optionally, one, two or more loading/unloading stations 1710*a*, 1710*b* may be provided. In some instances, a single operator configuration may be provided that may allow for a single individual load and/or unload the garments from the printing apparatus. Optionally, a dual operator configuration may be provided that may allow for two individuals to simultaneously load and/or unload the garments from the printing apparatus. Any type of multi-operator configuration may be provided that may allow for any plurality of individuals to load and/or unload the garments from the printing apparatus (e.g., two, three, four, five, six or more operators may load and/or unload the garments from the printing apparatus in parallel). Any of the operators of the printing apparatus need not move from their location while loading and/or unloading the garments. The printing apparatus may be controlled sot that the pallet assemblies and/or garments arrive at the appropriate station for each operator correctly. In some instances, a particular printing apparatus may be able to switch between single operator and multi-operator (e.g., dual operator) modes.

A fixed vision reader may be provided to scan an image, such as a barcode/QR code, as an operator is loading a garment. A barcode scanner, such as 1D, or 2D barcode scanner may be used. Any type of image capture device may be used to capture an image of a production barcode. In alternative embodiments, the image may include symbols, characters, strings, or any other visually discernible or recognizable features. An operator may no longer need to pre-scan any jobs into the production queue. The image may be recognized and any necessary configurations or processes for the printer apparatus may be automatically updated.

A printing apparatus may accept XML data that may be sent in conjunction with a print file. The data may manipulate parameters in one or more components of the printing apparatus.

Examples of parameters may include, but are not limited to, pretreatment drop size and drop volume, flash dryer temperature/duration, heat press temperature/duration, head height for white and color cabinets, and so forth. The XML data may affect dwell time of the pallet assembly at one or more stations. This may provide a user with an ability to apply unlimited "setups" dynamically for each individual image/garment scenario.

One or more heat press stations 1720*a*, 1720*b*, 1720*c* may be provided for the printing apparatus. A heat press may be designed to flatten fibers of a substrate in one or more portions of the process. The heat press may heat and/or press down a garment to prepare the garment for a desirable treatment.

For instance, a heat press station 1720*a* may be provided before pretreatment. The heat press station may be adjacent to and/or preceding a pretreatment station 2430. The heat press may create a paper-like surface for smooth adhesion and lay down of pretreatment liquid.

A heat press station 1720*b* may be provided before printing with white ink. The heat press station may be adjacent to and/or preceding a white printing station 1740. Some textile fibers may pop up after curing. This may be mitigated by adding the heat press after curing the pretreat and before printing with white ink.

Optionally, a heat press station 1720*c* may be provided before printing with color. The heat press station may be adjacent to and/or preceding a color printing station 2450. The heat press station may be provided after curing the white ink, and before applying the color ink. This may help eliminate or reduce any of the fibers that have re-emerged after curing the white ink.

It may be desirable to provide a heat press station prior to printing on a garment (e.g., printing pretreatment solution, printing with white ink, printing with color ink). The heat press station may be provided immediately prior to the respective printing station. This may aid in providing a flat smooth surface to optimize printing conditions. Heat press temperature and duration may be controlled via programmable logic controller (PLC) and PLC presets may be able to be toggled via XML commands. One or more preset configuration on the PLC may be provided.

One or more flash dryers 1760, 1770 may be provided. Infrared flash curing technology may be utilized. The flash dryers may be individually PLC-driven. The temperature and/or duration of each individual flash dryer may be controlled dynamically per print. The flash temperature and/or duration may be controlled via PLC and PLC presets, which may be able to be toggled via XML commands.

In some embodiments, a plurality of flash dryers may be provided between the pretreatment station and the white ink printing station. The plurality of flash dryers may be provided before a heat press station prior to the white ink printing station. Optionally, one, two, three, four or more flash dryers may be provided.

In some instances one or more flash dryers 1770 may be provided after the color ink printing station. The one or more flash dryers may be provided before a garment is unloaded. The flash dryer may optionally be provided for drying the neck tag region of the substrate. The flash dryer may dry both the neck tag region and a main print region of the substrate.

Print head protection mechanisms 1780 may be provided. A plurality of height and temperature sensors may be mounted above the print head protection region. The sensors may be arranged in any manner, such as individual sensors, rows of sensors, columns of sensors, arrays of sensors, or any other configuration. The print head protection region may be provided before a white ink printing station. The print head protection region may be provided after, or before a heat press station that precedes the white ink printing station.

The sensors may be used to detect if there are any wrinkles in the substrate (e.g., garment fabric), or if the substrate is too warm for the print heads. If any wrinkles are present, they may damage the print heads in a form of a 'heat strike'. Too much heat can also damage print heads. If the sensors detect any potential issues (e.g., wrinkles, heat), then the process may come to a halt to allow an operator to fix the issue. In some instances, if the sensors detect a condition that may be fixed without manual intervention (e.g., heat), then the dwell times may be adjusted to allow for desirable conditions to take place.

Figure 19:
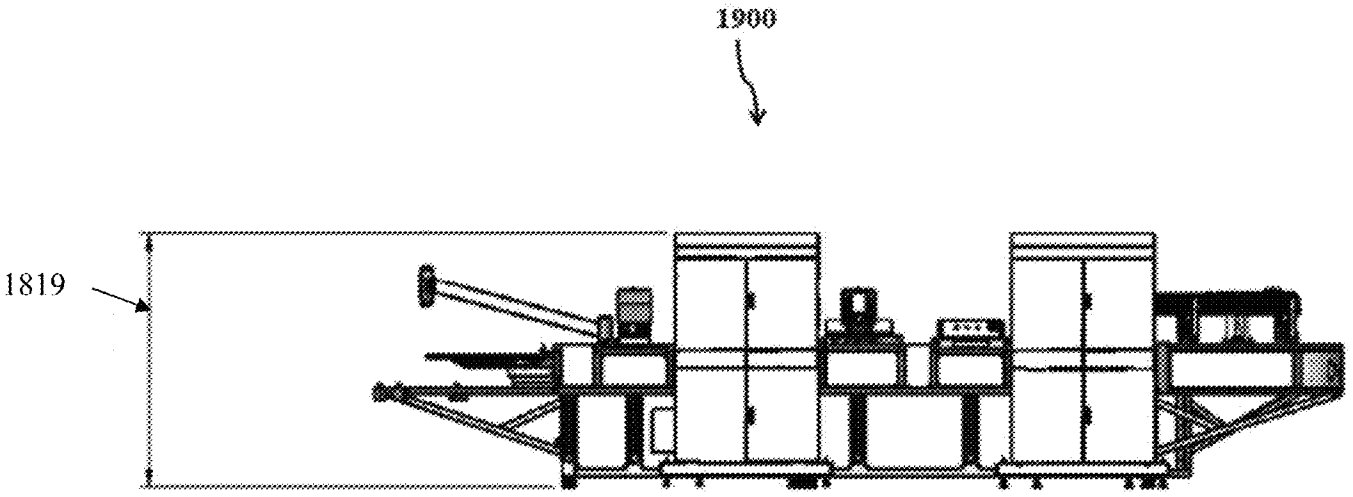
FIG. 19 shows a side view of a closed-loop, direct to garment printing apparatus.

FIG. 19 shows a side view of a closed-loop, direct to garment printing apparatus 1900.

Figure 20:
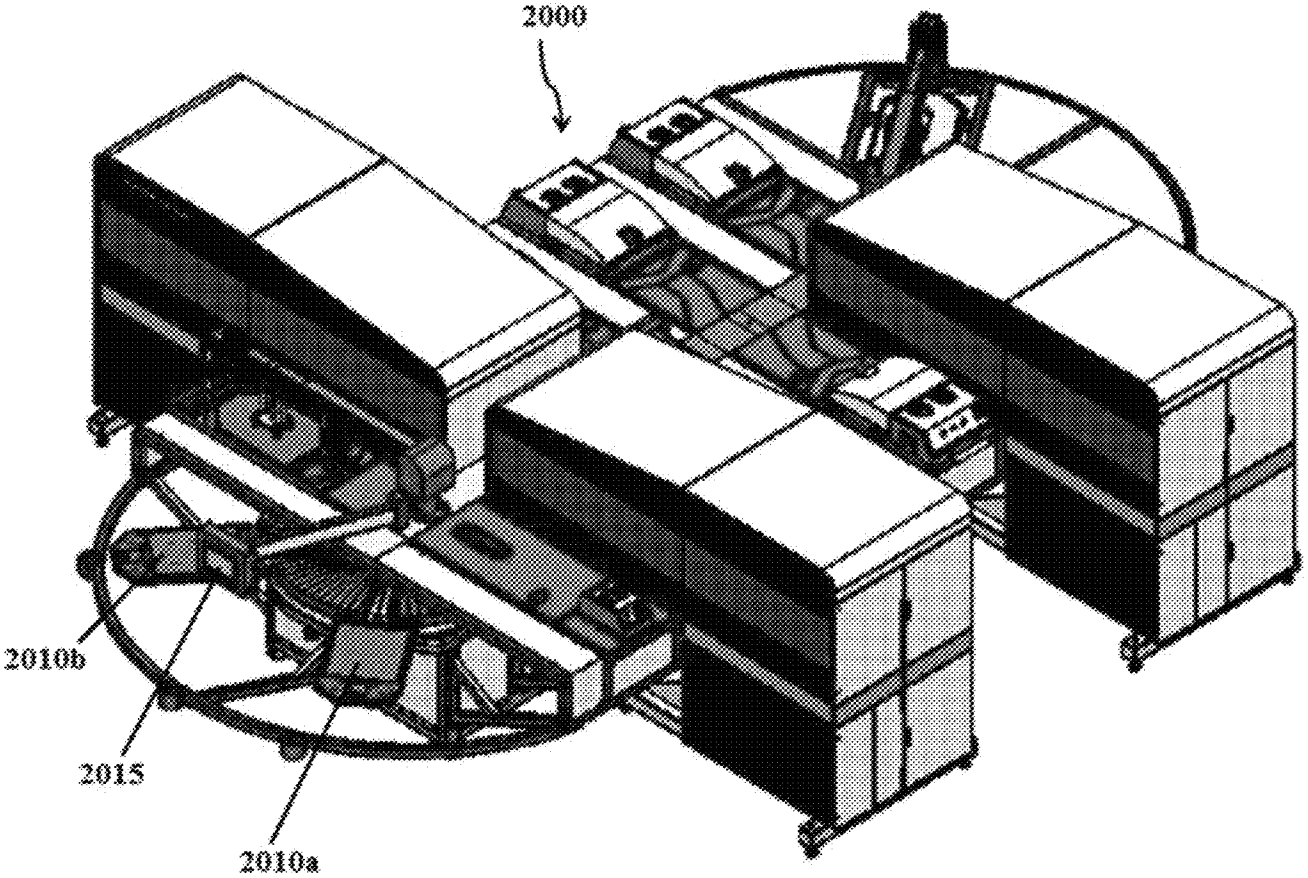
FIG. 20 shows a perspective view of a closed-loop, direct to garment printing apparatus.

FIG. 20 shows a perspective view of a closed-loop, direct to garment printing apparatus 2000. As previously described, multiple operator stations 2010*a*, 2010*b* may optionally be provided. The operators may share a control screen 2015, or each operator may have their own control screen. The control screen may allow for one or more commands to be provided, which may affect operation of the printing assembly.

As can be seen in FIG. 17, a white ink printing station 1740 and a color printing station 1750 may be provided. The white print heads and color print heads may be separated into separate digital printing stations. This may be desirable to produce a higher quality result. For instance, a combination of heat, time, and pressure between the white and color layers may produce a higher quality result on a more consistent basis. The white layer may be cured and optionally, pressure may be added to give a smooth hand feel to the final print. This may be obtained via the curing and heat press between the white ink printing station and the color ink printing station. Pallet assemblies provided herein may be reconfigured to accommodate different garment types or thicknesses.

Advantageously, the techniques herein provide for high-turnaround, closed-loop, direct to garment printing, producing a high quality printed fabric product in a short period of time. In particular, the techniques herein are faster at producing quality printed garments at scale than current systems (e.g., 300 per hour or more), while still remaining high quality and high resolution, yet only requiring a single operator for use, from start (inserting an untreated garment) to finish (removing the printed product) in a "wet-to-dry-to-wet" single-system serial process. Furthermore, the image resolution provided by this particular example embodiment may be better than conventional wet-on-wet systems, since there is no mixing or smearing of the inks with the pretreatment solution. Other advantages, such as contemporaneous tag printing, reduced pretreatment areas (e.g., pretreating only where needed based on the selected image), automatic system control (e.g., algorithms to adjust phases of the process based on various inputs and correlated functionalities), and many others may also be attained according to the specific embodiment described above.

As mentioned above, there are many different techniques for transferring images onto fabrics, such as the high-turnaround closed-loop DTG printing described above, as well as other example embodiments known in the industry (e.g., screen printing, heat transfer, other DTG printing techniques, etc.). No matter which of these substantially different embodiments is used for fabric image transfer, however, it is beneficial to lay at least the portion of the fabric to receive the image flatly in a wrinkle-free orientation in order to ensure the best transfer of an image onto the fabric. Typically, the fabric (e.g., tee shirt, towel, etc.) may be laid flat on a surface, such as a soft pad, stretched out, and fastened into place with clips or a frame. Where the fabric is multi-layered, such as the front and back of a shirt, the fabric may be slid over the surface such that only the top portion of the fabric is located on top of the pad, ready to receive the image.

Figure 12A:
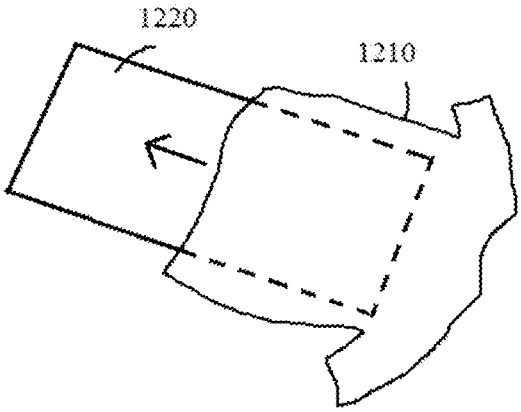
FIGS. 12A-12C illustrate examples of fabric substrate support configurations.
Figure 12B:
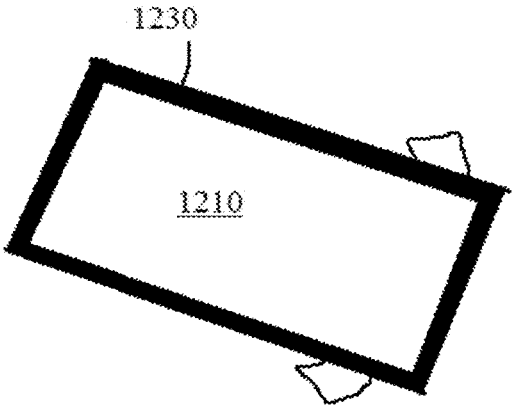
Figure 12C:
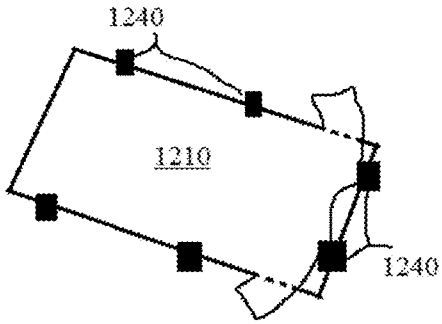

Illustrations of these concepts are shown in FIGS. 12A-12C, where, as shown in FIG. 12A, a fabric 1210 (fabric substrate 102 above) is placed over a support 1220 (image transfer portion 1210*a* on the top of support 1220, remaining portion 1210*b* illustratively hanging from the bottom). The fabric may be a garment, as described elsewhere herein. The support 1220 may be a pallet (e.g., pallet 104 above) of a large DTG printing machine, or else may be a single use support for silk screening or other image transfer technique, and may be any suitable shape (e.g., rectangular, square, shaped like a flattened shirt, etc.). As shown in FIG. 12B, a frame 1230 may be lowered onto the fabric, latching it into position, while as shown in FIG. 12C, any clip or clamping mechanism 1240 may also be used.

Some supports may have a hard surface, while others may have a padded top surface, such as foam or rubber, generally to provide a degree of compression with the frame, extra cushioning for press processes, or else absorption of pretreat solution or ink, and so forth. While traditional supports may be flat, not all fabric substrates are flat. As such, the distance between the fabric substrate and the image transfer components (e.g., print heads) may fluctuate between fabric substrates, or even on the same substrate. Such fluctuation may affect image quality due to a variety of factors, such as print head interference (e.g., hitting raised portions of a garment), silk screen interference (e.g., angling the screen due to raised portions of a garment, creating separation of the screen from the garment), heat transfer press interference, and so on.

The techniques herein provide reconfigurable support pads for fabric image transfers. In particular, the techniques herein provide for various adjustable configurations of portions of the support, which may be changed for different thicknesses of garments, and more particularly, that allow for varied thicknesses found on the same garment. For example, by configuring the support in a first "flat" configuration, a plain tee shirt may lay flat, and then configuring the support in a second "two-tiered" configuration, with one portion lower (or higher) than the other, allows for a hoodie with a thicker pocket portion at the "belly" of the garment to also lay flat. Other configurations are also available, whether manually adjusted or else dynamically controlled (e.g., using actuators) based on the type of garment selected on an associated control system.

FIGS. 13A-13D illustrate an example reconfigurable pad ("mat", "support", etc.) system that allows changing the configuration of the system for different thicknesses of garments/fabric substrates (tees, hoodies, etc.). The reconfigurable system may thus adapt between different types of substrates (e.g., thinner tee shirts versus thicker sweatshirts), or else for varying thicknesses on a single substrate (e.g., hoodies with pockets). Note that though generally described in terms of a direct-to-garment printing embodiment or screening/printing embodiment, the pads may be applied to other embodiments as well, whether specifically denoted herein or else as would be appreciated by those skilled in the art.

Figure 13A:
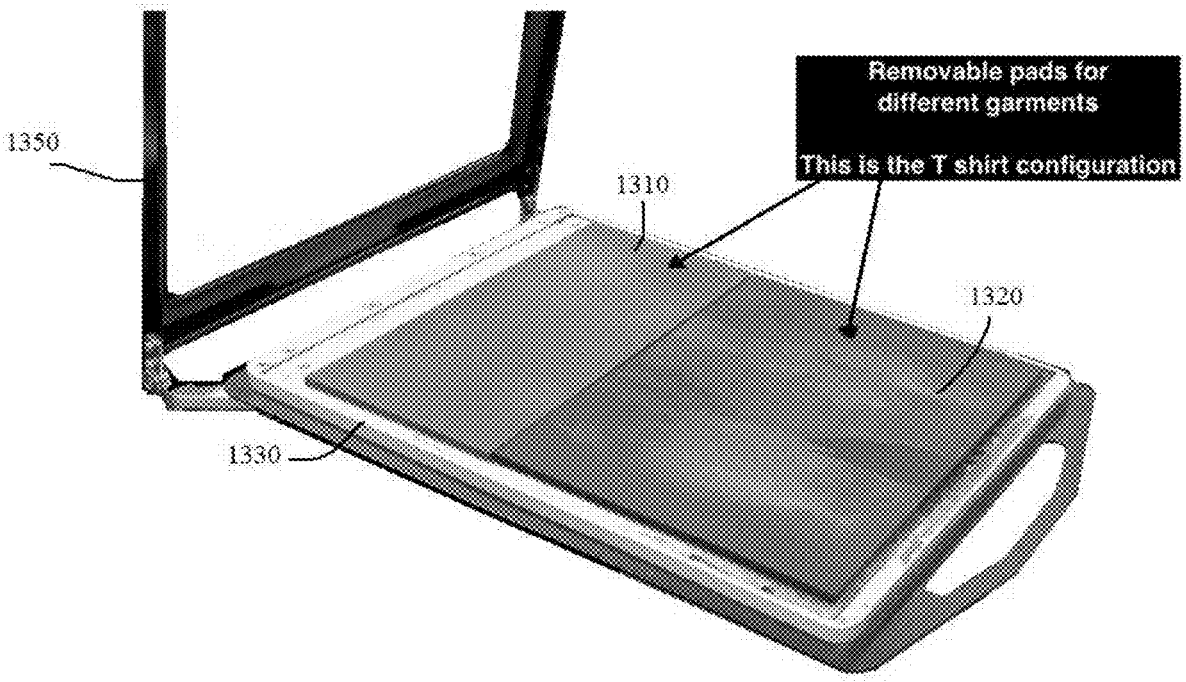
FIGS. 13A-13D illustrate examples of reconfigurable support pads for fabric image transfers.
Figure 13B:
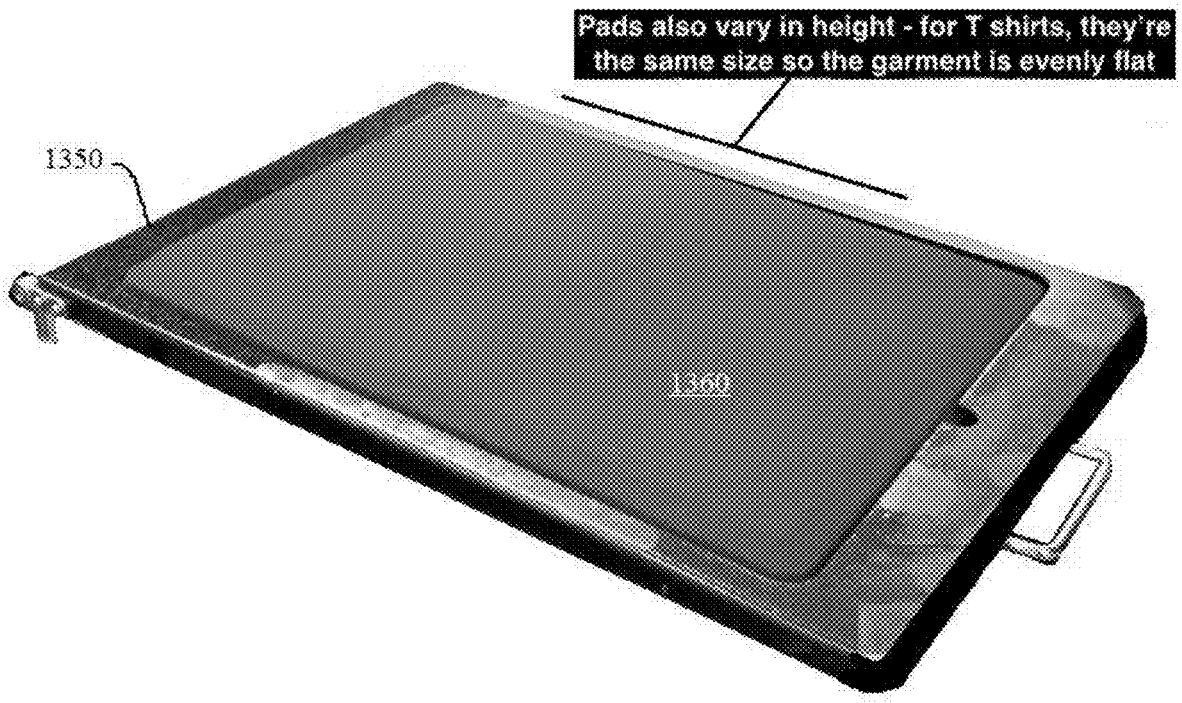
Figure 13C:
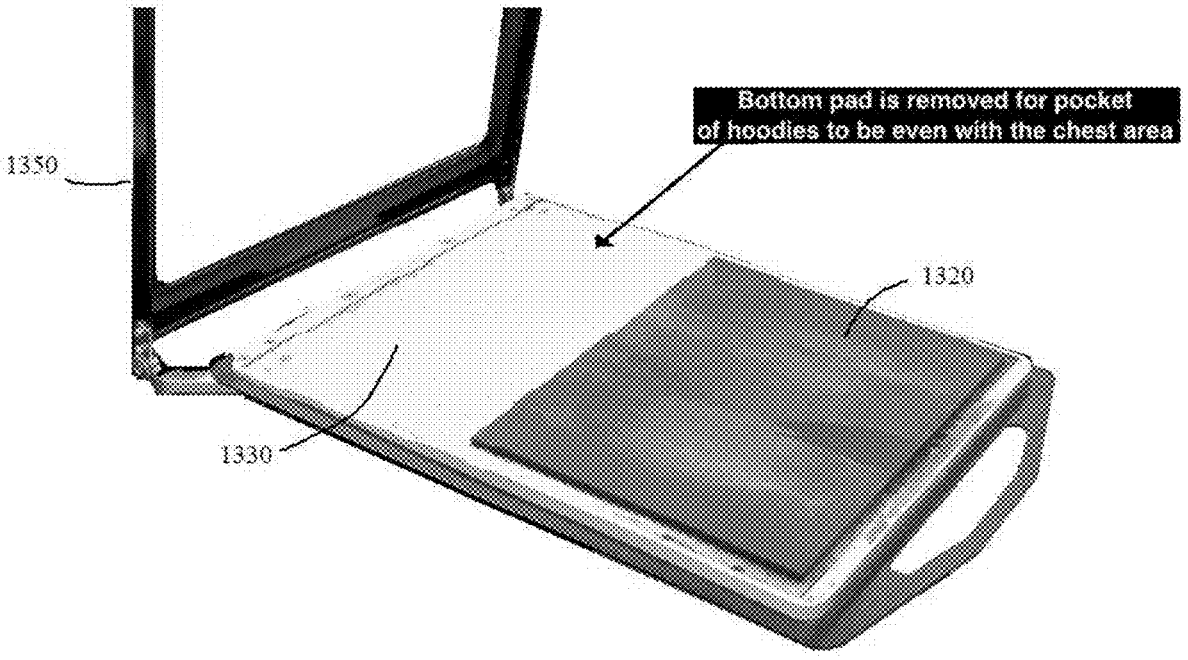
Figure 13D:
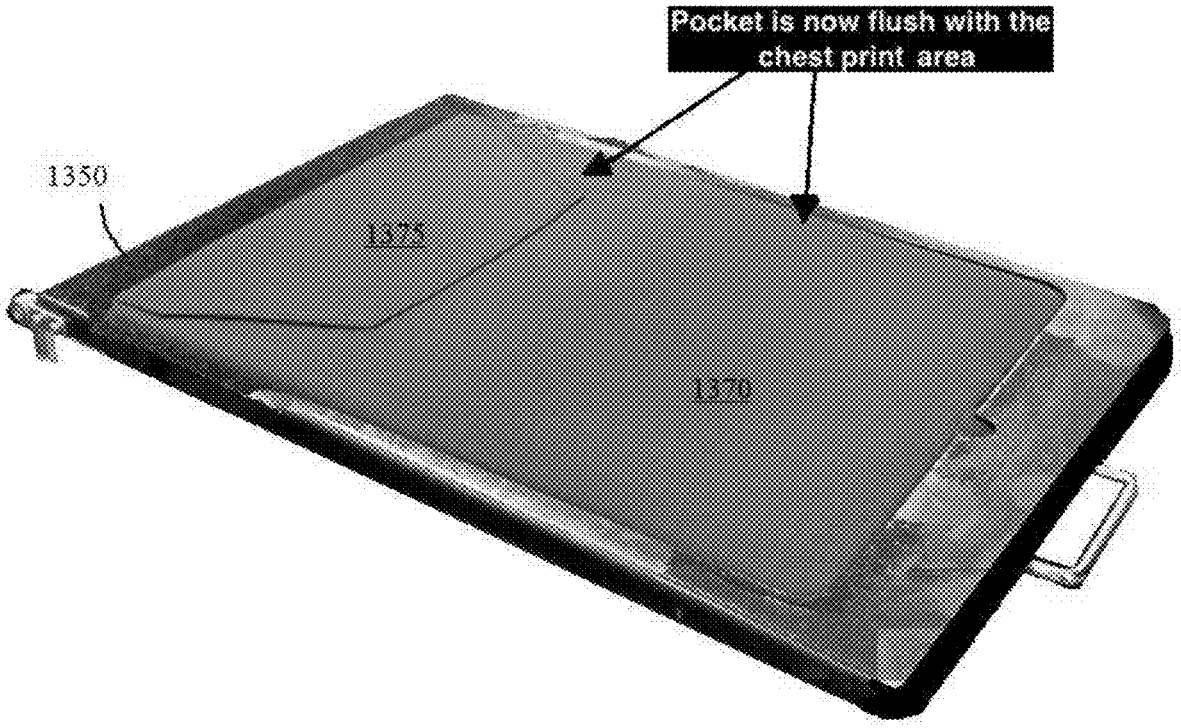

With reference specifically to FIG. 13A, a first pad 1310 and second pad 1320 may be arranged on a support 1330 (e.g., pallet) in a "flat" (e.g., tee shirt) orientation, i.e., being both the same height. The pads may be held on by gravity, friction, the frame 1350 (e.g., once compressed by a fabric substrate), pegs, hook-and-loop fasteners, snaps, magnets, static, locking features, clamps, and so on. Once the frame 1350 is closed onto the fabric substrate 1360 as shown in FIG. 13B, the garment is flat and ready for image transfer. Alternatively, as shown in FIG. 13C, by removing the pad 1310, then as shown in FIG. 13D, a hoodie 1370 with associated pocket 1375, which creates a thicker portion of the garment, will then also result in a flat surface, (e.g. coplanar surface, parallel surface, surface that is perpendicular to gravity), for image transfer, despite the thicker portion 1375 (now "sunk" into the space created as a result of removing pad 1310).

The support may bear the weight of any number of pads. For instance, a support may bear the weight of one, two, three, four, five, six, seven, eight, nine, ten or more pads. The pads may be removed or attached as needed to accommodate different garments. The pads may have different sizes and/or shapes from one another. The pads may complement the size and/or shape of a feature on a garment. For instance, a pad may have the same size and/or shape as a pocket, collar, panel, strap, zipper, opening, cut-out, or other feature on a garment. In some instances, pads adjacent to one another may directly abut and/or contact one another. Alternatively, gaps may be provided between pads. In some instances, the edges of the pads that face one another may have complementary contours and/or shapes. For instance, two or more pads may be fitted together without substantial gaps, in the manner of a puzzle. In some instances, pads may be added or removed to accommodate different thicknesses of fabric. In some instances, pads of different thicknesses may be used to different fabric variations.

Figure 14A:
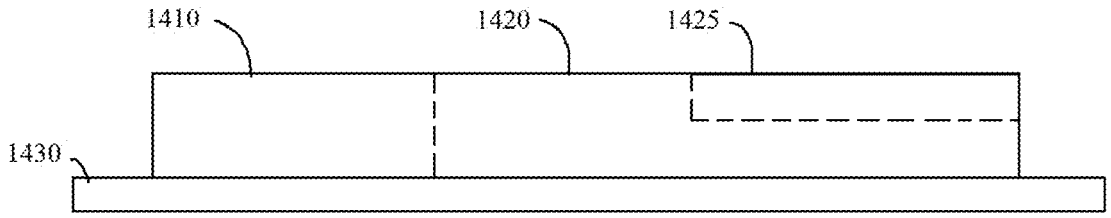
FIGS. 14A-14B illustrate further examples of reconfigurable support pads for fabric image transfers.
Figure 14B:
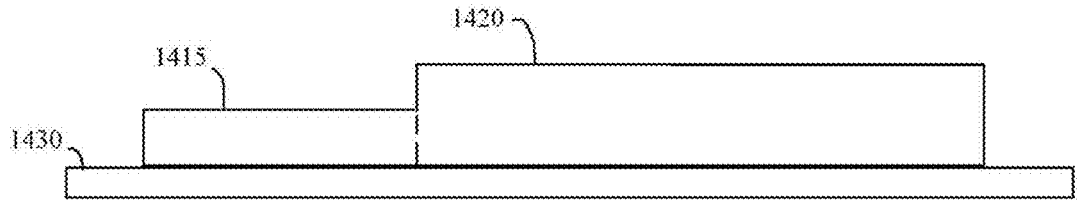

FIGS. 14A-14B illustrate simplified side cutaway views of example options for pad configurations in order to demonstrate certain aspects of the embodiments herein. (Note that many other configurations are available, and those shown are not meant to limit the scope of the present disclosure.) For instance, as shown in FIG. 14A, a first pad 1410 and second pad 1420 are the same height, and completely separable from each other. If pad 1410 were to be removed, for example, then the garment would rest solely on pad 1420 and the base 1430 (e.g., the pallet, frame, or other underlying support structure). Another illustrative pad 1425 shows how different pads may be complimentary (additive) to each other, whether arranged as only a portion of the underlying pad 1420 as shown (e.g., to create a lower portion and higher portion of pad 1420) or else the same size as the underlying pad (to add or remove pads on top of each other to increase or decrease the overall height/thickness in particular areas). For example, as shown in FIG. 14B, a reduced-thickness pad 1415 is shown, which may be used to reduce the surface height of the combined pads at that location. To bring the height of this location up to the height of the other pad 1420, either a complete replacement pad 1410 may be used as in FIG. 14A, or else an additional reduced-height pad 1415 may be placed on top of the pad 1415 shown.

Many different layered arrangements of various thicknesses of pads may be used herein, and those shown are merely examples demonstrating the versatility of the techniques described herein. Pads may be at least 0.25 centimeter (cm), 0.5 cm, 1 cm, 2 cm, 3 cm, 4 cm, 5 cm, 6 cm, 7 cm, 8 cm, 9 cm, 10 cm, 11 cm, 12 cm, 13 cm, 14 cm, 15 cm, 16 cm, 17 cm, 18 cm, 19 cm, 20 cm thick. Pads may have thicknesses less than any of the values provided herein, or falling within a range between any two of the values provided herein. Thickness of pads used may vary by at least 1%, 5%, 10%, 25%, 50%, 75%, 100%, 200%, 300%, or 500%. The pads may be provided to accommodate different variations in the thickness of fabric. For instance, the pads may allow a top surface of the garment to be at a single level (e.g., coplanar). The pads may allow the print areas of the garment to be at a single level (e.g., coplanar), even if the thickness of the garment varies by at least 1%, 5%, 10%, 25%, 50%, 75%, 100%, 200%, 300%, or 500%. The pads may allow the print areas of the garment to be at a single level (e.g., coplanar), even if the thickness of the garment varies by at least 0.1 mm, 0.5 mm, 1 mm, 2 mm, 3 mm, 5 mm, 7 mm, 1 cm, 1.5 cm, 2 cm, 3 cm, 5 cm, or 10 cm.

Pads may be provided on a support or over one another, and may be arranged in a removable manner. They may be manually or automatically removed. The pads may be moved from one position to another position. The pads may have fixed positions relative to one another or the support. The pads may have limited optional positions relative to one another or the support. Or they may be freely placed in any position relative to one another or to the support. The pads may remain on the support or on one another with aid of one or more fasteners (e.g., pegs, clamps, hook and loop fasteners, screws), locking mechanisms, magnets, friction, adhesives, press-fit mechanisms, static, or any other features. When attached, the pads may not slide relative to the support or on one another.

Two or more pads may be arranged in a vertical manner. For instance, at least a portion of a first pad may overlie at least a portion of a second pad, or vice versa. Any number of pads may be stacked on top of one another to achieve a desired thickness. Pads overlying one another may have the same size and/or shape. Alternatively, some of the pads overlying one another may have different sizes and/or shapes. Pads may have variable thicknesses. In some instances, pads may have a gradually variable thickness, such as a slope or slant. Optionally, the pads may have multiple regions, with different thicknesses. For instance, a pad may have a first region with a first thickness and a second region with a second thickness. In some instances, additional pads may fit into the region that has a lesser thickness.

The material used for the pads can be any suitable material according to the desired characteristic of the image transfer system. For instance, some systems may prefer a hard material, such as metal or plastic or silicone, while others may prefer a softer material, such as foam or rubber. Still others may prefer absorbent materials, such as felt or sponge. In some instances, pad materials may be selected based on frictional qualities. For instance, a high-friction pad may be desirable to prevent the garment from slipping. Combinations of the materials may also be used, and pads may be different materials on the same pallet (e.g., soft under the print area, hard under the pockets, and so on). Notably, in one embodiment, different pad portions on the same pallet may be the same height/thickness, but may be different materials, such as, for example, a hard material under the image area for a heat press transfer, and a soft material under the pocket area, such that if there is a hoodie with a belly pocket, the pocket portion will compress the soft pad to result in a flat overall surface. A single layer of ink may be transferred to the flat overall surface of the fabric or garment without rearranging the fabric or garment. Other configurations are possible according to the techniques herein, and those mentioned are merely examples of the many possibilities afforded by the embodiments herein.

Figure 15:
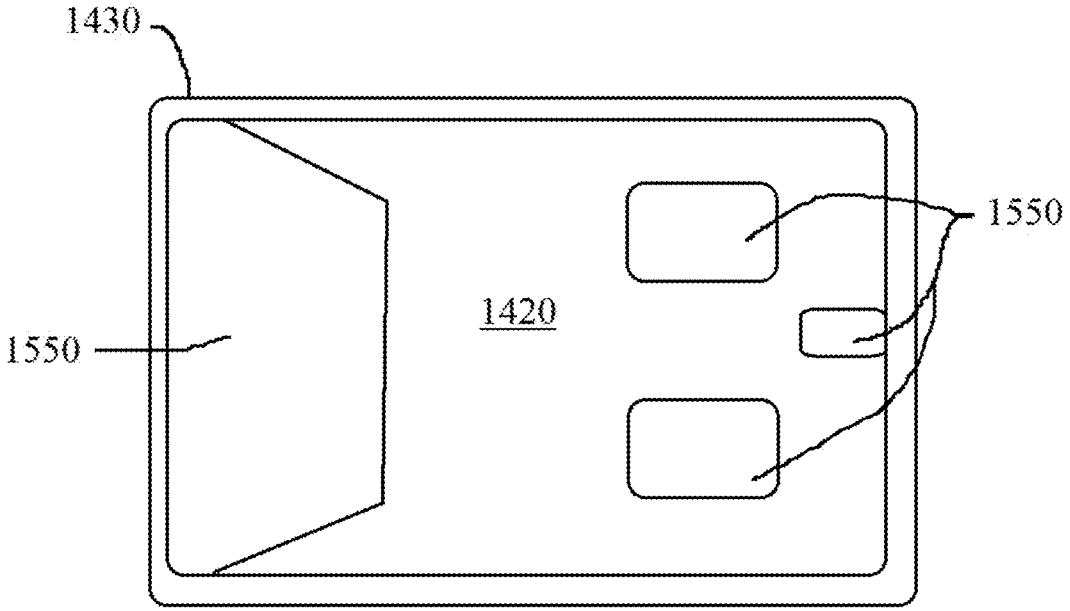
FIG. 15 illustrates an example of alternative pad portion locations.

In addition to the pads being divided across the entire width of the pad, other configurations of pad divisions may be made within the scope of the embodiments herein. For example, as shown in FIG. 15, pad portions 1550 may be defined for shirts with chest pockets, collar buttons, belly pockets (shaped more like the pocket than merely a straight division), or any other shape, size, orientation, and so on. Such pad portions 1550 may be full-height pads, or else partial height pads, as described above. The pads may have different shapes or dimensions. Pads that can be placed on top of one another may have different materials with at least one different material property, such as elastomeric properties, melting temperatures, hardness, etc. The garment or fabric may be fixed into position on the pads with the aid of a frame. The frame may be a clamshell configured to rotate about a hinge.

Figure 16A:
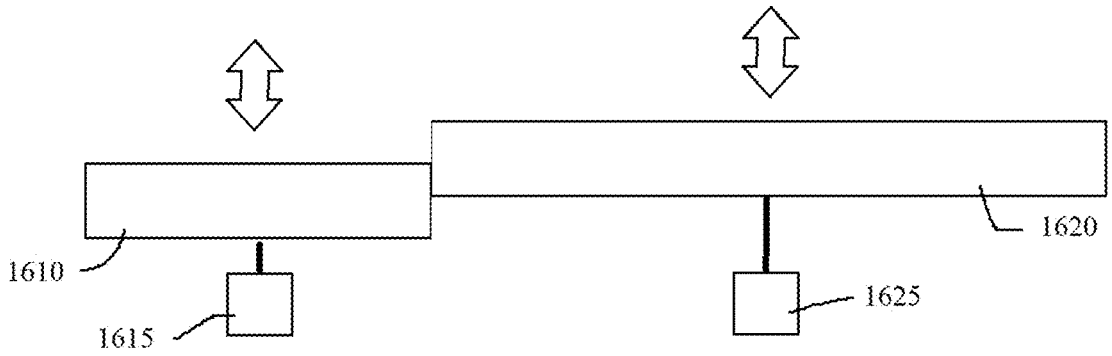
FIGS. 16A-16B illustrate examples of dynamically adjustable pad height configurations.
Figure 16B:
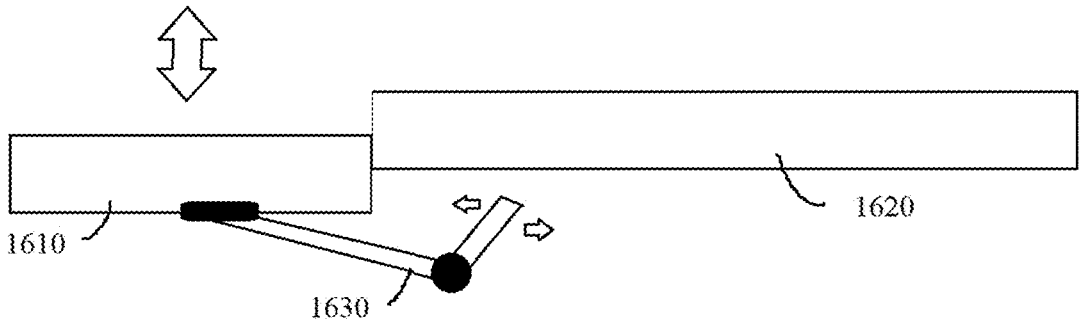

Notably, while the pads above have generally been described as a manually configurable arrangement, other embodiments are also conceived herein, such as various controlled actuators, levers, etc., which may be manually controlled by an operator, or may be controlled by a computerized control system (e.g., based on a determination of the type, style, configuration, etc., of the fabric substrate being placed on the pads). For instance, as shown in FIG. 16A, pad 1610 may be controlled vertically by an associated actuator 1615, and pad 1620 may either be stationary, or as shown, controlled by an associated actuator 1625. The actuator can be a mechanical arm, ratchet, gear or pulley system. Alternatively, manual levers, such as lever 1630 as shown in FIG. 16B, may be used to adjust the position/height of the associated pad(s), accordingly. The pads may have an adjustable vertical position with aid of one or more levers.

The pads may be configured to have top surfaces that remain parallel to one another while the pads are adjusted in a vertical position. The pads may be sufficiently rigid to support the overlying garment. In some instances, the pads may be controlled so that the user manipulates the pads to be angled relative to one another, or remain parallel relative to one another. At least two pads, three pads, four pads, five pads, six pads, seven pads, eight pads, nine pads, 10 pads may share a common support. The pads may move relative to the support. The pads may move vertically relative to the support. In some instances, the pads may be supported by multiple supports. For instance, a first pad may be supported by a first support and a second pad may be supported by a second support. The supports may or may not move relative to one another. The supports may move vertically and support the pads. In some instances, the movement of the pads may be limited to the vertical direction. Alternatively, the pads may be moved horizontally separately or simultaneously. At least two pads, three pads, four pads, five pads, six pads, seven pads, eight pads, nine pads, 10 pads, may be configured to have an adjustable vertical position relative to one another.

Advantageously, the techniques herein provide reconfigurable support pads for fabric image transfers, allowing for efficient and accurate control of the support surface to account for different thicknesses of fabric substrates (e.g., thin tee shirts versus thick sweatshirts) and for variations of thickness on a single fabric substrate (e.g., pockets on a hoodie or tee shirt). The techniques herein also contemplate the process of configuring the pads prior to transferring an image (e.g., printing, heat transferring, silk screening, etc.), and reconfiguring the pads between uses (e.g., between runs, or else during the same run). The configuration may be manual, or else controlled dynamically as noted above. The techniques herein thus also described a product (e.g., printed garment) produced according to the process(es) described above.

While there have been shown and described illustrative embodiments that provide for reconfigurable support pads for fabric image transfers, it is to be understood that various other adaptations and modifications may be made within the scope of the embodiments herein. For example, the embodiments may be used in a variety of types of fabric printing, such as canvas, towels, sheets, pillows, and many other fabric types and functions, particularly any with varying thicknesses of material, and the techniques herein need not be limited to the illustrative garment implementations as shown. Furthermore, while the embodiments may have been demonstrated with respect to certain configurations (e.g., pad divisions, pad height differences, etc.), physical orientations (horizontal, vertical, inserts, etc.), or system component form factors (e.g., silk screening, DTG printing, high-turnaround closed-loop DTG printing, heat pressing, etc.), other configurations may be conceived by those skilled in the art that would remain within the contemplated subject matter of the description above, including non-image transfer embodiments (e.g., ironing/pressing systems). In particular, the foregoing description has been directed to specific embodiments. It will be apparent, however, that other variations and modifications may be made to the described embodiments, with the attainment of some or all of their advantages.

Notably, it is expressly contemplated that certain components and/or elements described herein can be implemented as software being stored on a tangible (non-transitory) computer-readable medium (e.g., disks/CDs/RAM/EEPROM/etc.) having program instructions executing on a computer, hardware, firmware, or a combination thereof. For instance, the apparatus and/or the stations may comprise one or more processors that may execute one or more steps and/or send control signals to one or more components of the apparatus and/or stations. The apparatus and/or stations may comprise a memory storage unit, which may comprise non-transitory computer readable medium including the code, logic or instructions to for any of the steps described.

Additionally, the certain aspects of the system described herein may be performed by (or in conjunction with) a computing device having one or more network interfaces (e.g., wired, wireless, etc.), at least one processor, and a memory. The network interface(s) may contain the mechanical, electrical, and signaling circuitry for communicating data to computer networks (e.g., local area networks, the Internet, etc.). The memory comprises a plurality of storage locations that are addressable by the processor for storing software programs and data structures associated with the embodiments described herein. The processor may comprise hardware elements or hardware logic adapted to execute the software programs and manipulate the data structures. An operating system, portions of which is typically resident in memory and executed by the processor, functionally organizes the device by, among other things, invoking operations in support of software processes and/or services executing on the device. These software processes and/or services may illustratively include one or more control processes, user interface processes, system maintenance processes, point of sale collaboration processes, and so on, for performing one or more aspects of the techniques as described herein.

Illustratively, certain aspects of the techniques described herein may be performed by hardware, software, and/or firmware (such as in accordance with the various processes of a computing device local to or remote from the system), which may contain computer executable instructions executed by processors to perform functions relating to the techniques described herein. It will be apparent to those skilled in the art that other processor and memory types, including various computer-readable media, may be used to store and execute program instructions pertaining to the techniques described herein. Also, while the description illustrates various processes, it is expressly contemplated that various processes may be embodied as modules configured to operate in accordance with the techniques herein (e.g., according to the functionality of a similar process). Further, while the processes may be operational separately, or on specific devices, those skilled in the art will appreciate that processes may be routines or modules within other processes, and that various processes may comprise functionality split amongst a plurality of different devices (e.g., client/server relationships).

Accordingly this description is to be taken only by way of example and not to otherwise limit the scope of the embodiments herein. Therefore, it is the object of the appended claims to cover all such variations and modifications as come within the true spirit and scope of the embodiments herein.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A pallet assembly for direct-to-garment printing, comprising:

one or more supports configured to accept a garment, said garment comprising a print area; and a plurality of pads, wherein the pads are configured to lie under at least a portion of the print area of the garment, and wherein top surfaces of at least two of the pads are configured to have an adjustable vertical position relative to one another;

wherein the at least two pads are configured to have an adjustable vertical position with aid of one or more levers.

2. The pallet assembly of claim 1 wherein the at least two pads are further configured to have top surfaces that can remain parallel to one another while the pads are adjusted in a vertical direction.

3. The pallet assembly of claim 1, wherein the first and second pads share a common support.

4. The pallet assembly of claim 1 wherein the at least two pads have separate supports that are configured to have an adjustable vertical position relative to one another.

5. A method of using the pallet assembly of claim 1 for transferring a layer of ink to a fabric with a variable thickness, comprising the steps of:

(a) using the one or more levers to adjust a first pad relative to a second pad such that a difference in height between said first pad and said second pad accommodates a variation in thickness in a first portion of said fabric as compared to a second portion of said fabric;

(b) placing said first and second portions of said fabric over said first and second pads such that a top surface of said first and second portions of said fabric are within a single plane;

(c) fixing a position of said fabric relative to said first pad and said second pad; and (d) transferring said layer of ink to said first and second portions of said fabric without rearranging said first and second portions of said fabric.

6. The method of claim 5, wherein the first pad and the second pad are positionable so that at least a portion of the second pad overlies at least a portion of the first pad.

7. The method of claim 5, further comprising attaching different pads such that the first pad and the second pad have different shapes or dimensions.

8. The method of claim 5, further comprising providing different pads such that the first pad and the second pad are constructed from different materials having at least one different material property.

9. The pallet assembly of claim 1, wherein the second pad is stationary.

10. The pallet assembly of claim 1, further comprising an independent actuator for adjusting a vertical position of the second pad independent of the first pad.

11. A method of transferring a layer of ink to a fabric with a variable thickness, comprising the steps of:

(a) using one or more levers to adjust a first pad vertically relative to a second pad such that a difference in height between said first pad and said second pad accommodates a variation in thickness in a first portion of said fabric as compared to a second portion of said fabric;

(b) placing said first and second portions of said fabric over said first and second pads such that a top surface of said first and second portions of said fabric are within a single plane;

(c) fixing a position of said fabric relative to said first pad and said second pad;

(d) transferring said layer of ink to said first and second portions of said fabric without rearranging said first and second portions of said fabric; and (e) fixing the fabric into position with aid of a frame.

12. The method of claim 11, wherein the frame is a clamshell configured to rotate about a hinge.

13. The method of claim 11, further comprising applying a layer of pretreatment fluid to the first and second portions of said fabric prior to transferring the layer of ink.

* * * * *